US009705209B2

(12) United States Patent
Sabo

(10) Patent No.: US 9,705,209 B2
(45) Date of Patent: Jul. 11, 2017

(54) INSULATION DISPLACEMENT CONNECTOR AND CONTACTS THEREOF

(71) Applicant: FCI AMERICAS TECHNOLOGY LLC, Carson City, NV (US)

(72) Inventor: James M. Sabo, Etters, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/785,004

(22) PCT Filed: Apr. 16, 2014

(86) PCT No.: PCT/US2014/034289

§ 371 (c)(1),
(2) Date: Oct. 16, 2015

(87) PCT Pub. No.: WO2014/172414

PCT Pub. Date: Oct. 23, 2014

(65) Prior Publication Data

US 2016/0072200 A1 Mar. 10, 2016

Related U.S. Application Data

(60) Provisional application No. 61/813,489, filed on Apr. 18, 2013.

(51) Int. Cl.

| | |
|---|---|
| ***H01R 4/24*** | (2006.01) |
| ***H01R 12/53*** | (2011.01) |
| ***H01R 43/01*** | (2006.01) |

(52) U.S. Cl.

CPC ..... *H01R 4/2445* (2013.01); *H01R 4/2425* (2013.01); *H01R 4/2466* (2013.01); *H01R 12/53* (2013.01); *H01R 43/01* (2013.01)

(58) Field of Classification Search

CPC .... H01R 4/2445; H01R 4/2466; H01R 43/01; H01R 4/2425

(Continued)

(56) References Cited

U.S. PATENT DOCUMENTS 4,026,013 A * 5/1977 Hughes ..... H01F 41/10 29/754
4,192,570 A * 3/1980 Van Horn ..... H01R 4/245 439/402

(Continued)

FOREIGN PATENT DOCUMENTS

FR 2852744 A1 9/2004
WO WO 2012/123811 9/2012

OTHER PUBLICATIONS

Extended European Search Report for European Application No. 14784685.1 dated Nov. 10, 2016.

(Continued)

*Primary Examiner* — Harshad Patel
(74) *Attorney, Agent, or Firm* — Wolf, Greenfield & Sacks, P.C.

(57) ABSTRACT

An insulation displacement contact comprises an electrically conductive contact body including a mounting portion that is configured to receive a complementary electrical component so as to contact an electrical terminal of the complementary electrical component, and a mating portion configured to attach to an electrical cable, the mating portion including a slot that extends into the contact body, and at least one piercing member that at least partially defines the slot such that, when the slot receives an electrical cable, the piercing member pierces an outer electrically insulative layer of the electrical cable and contacts an electrical conductor of the electrical cable that is disposed inside the electrically insulative layer.

13 Claims, 27 Drawing Sheets

(58) Field of Classification Search
USPC ..... 439/404, 395, 399–402, 406, 407, 396, 439/397
See application file for complete search history.

(56) References Cited

U.S. PATENT DOCUMENTS

| | | | | |
|---|---|---|---|---|
| 4,648,676 | A * | 3/1987 | Carrell | H01R 4/2462 439/404 |
| 5,022,868 | A | 6/1991 | Legrady | |
| 5,551,889 | A * | 9/1996 | Kozel | H01R 29/00 439/404 |
| 6,325,659 | B1 * | 12/2001 | Heinzen | H01R 4/2429 439/397 |
| 2004/0185703 | A1 | 9/2004 | Lee | |
| 2007/0254521 | A1 * | 11/2007 | D'Agostini | H01R 4/2445 439/404 |
| 2011/0059632 | A1 | 3/2011 | Bishop | |
| 2011/0217866 | A1 | 9/2011 | Roosdorp et al. | |
| 2012/0003850 | A1 | 1/2012 | Bishop et al. | |

OTHER PUBLICATIONS

International Search Report and Written Opinion for International Application No. PCT/US2014/034289 dated Aug. 29, 2014.
International Preliminary Report on Patentability for International Application No. PCT/US2014/034289 dated Oct. 29, 2015.

* cited by examiner

INSULATION DISPLACEMENT CONNECTOR AND CONTACTS THEREOF

CROSS-REFERENCE TO RELATED APPLICATIONS

This application is the National Stage of International Application No. PCT/US2014/034289, filed Apr. 16, 2014, which claims the benefit of U.S. application No. 61/813,489, filed Apr. 18, 2013, the disclosures of which are incorporated herein by reference in their entireties.

BACKGROUND

Insulation displacement connectors are configured to electrically connect one or more electrical cables to a complementary electrical component, such as a printed circuit board. For instance, insulation displacement connectors include at least one insulation displacement contact having a mating portion configured to be mate with the complementary electrical component, and a cable piercing end that is configured to at least partially receive an electrical cable. Electrical cables typically include at least one electrically insulative layer and an electrical conductor that is disposed inside the electrically insulative layer. The insulation displacement contact of the insulation displacement connector is configured to pierce the outer layer of insulation of the electrical cable so as to make contact with the electrical conductor, thereby placing the electrical conductor in electrical communication with the complementary electrical component. Insulation displacement connectors can be desirable, as they allow for connection to an insulated cable without first stripping the electrical insulation from the conductor.

SUMMARY

An insulation displacement contact can include an electrically conductive contact body. The contact body can include a mounting portion that is configured to receive an edge of a complementary electrical component so as to contact an electrical terminal of the complementary electrical component. The contact body can further include a mating portion configured to attach to an electrical cable. The mating portion can include a slot that extends into the contact body, and at least one piercing member that at least partially defines the slot such that, when the slot receives an electrical cable, the piercing member pierces an outer electrically insulative layer of the electrical cable and contacts an electrical conductor of the electrical cable that is disposed inside the electrically insulative layer.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
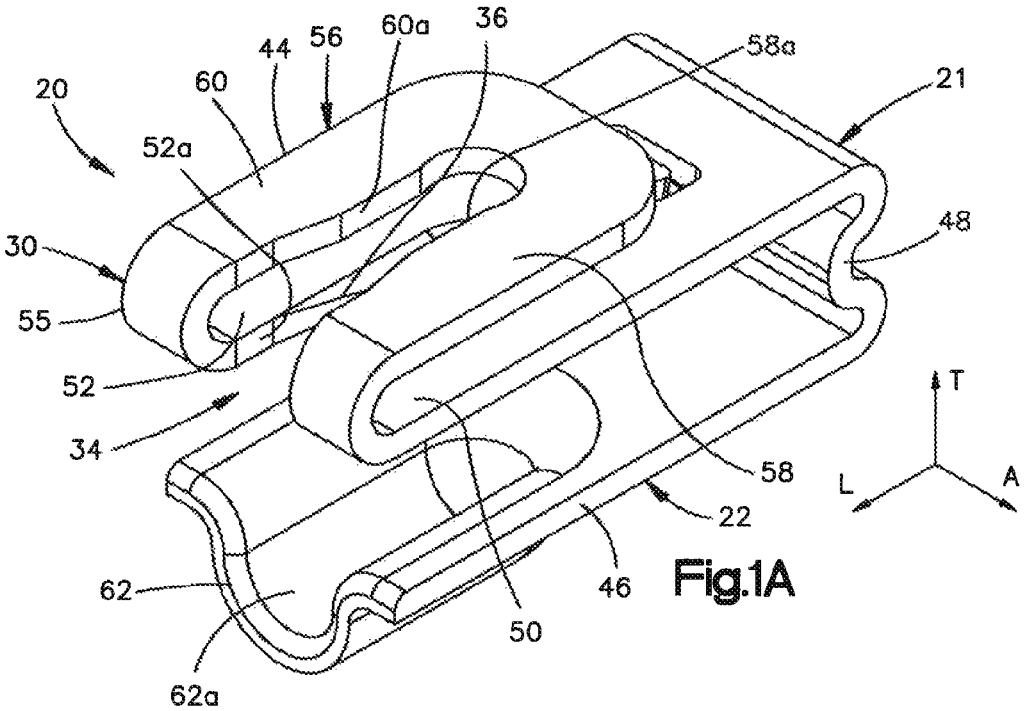
FIG. 1A is a perspective view of an insulation displacement contact constructed in accordance with one embodiment.
Figure 1B:
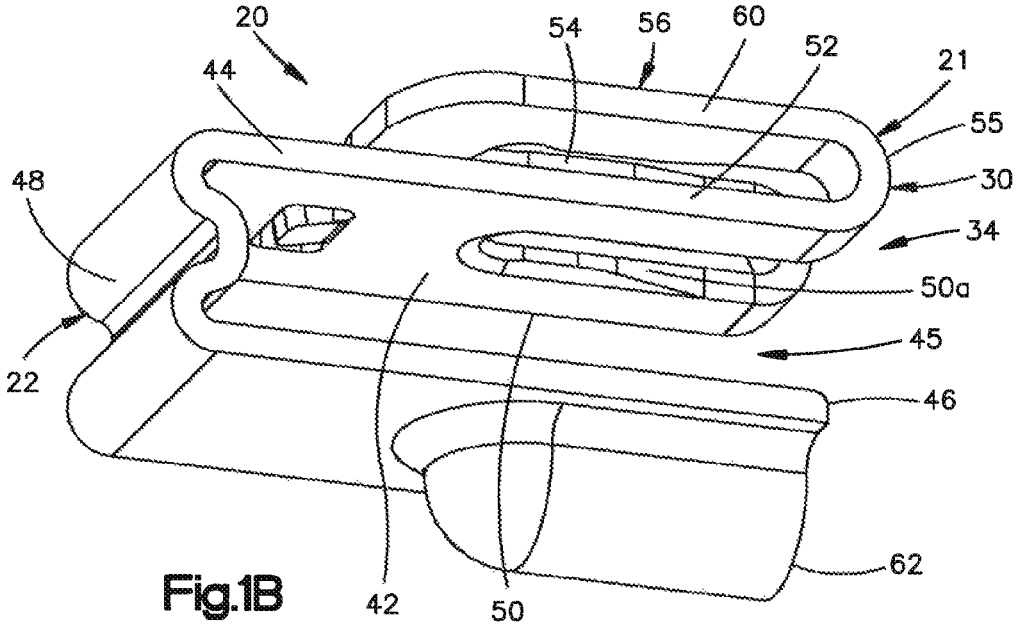
FIG. 1B is another perspective view of the insulation displacement connector illustrated in FIG. 1A.
Figure 1C:
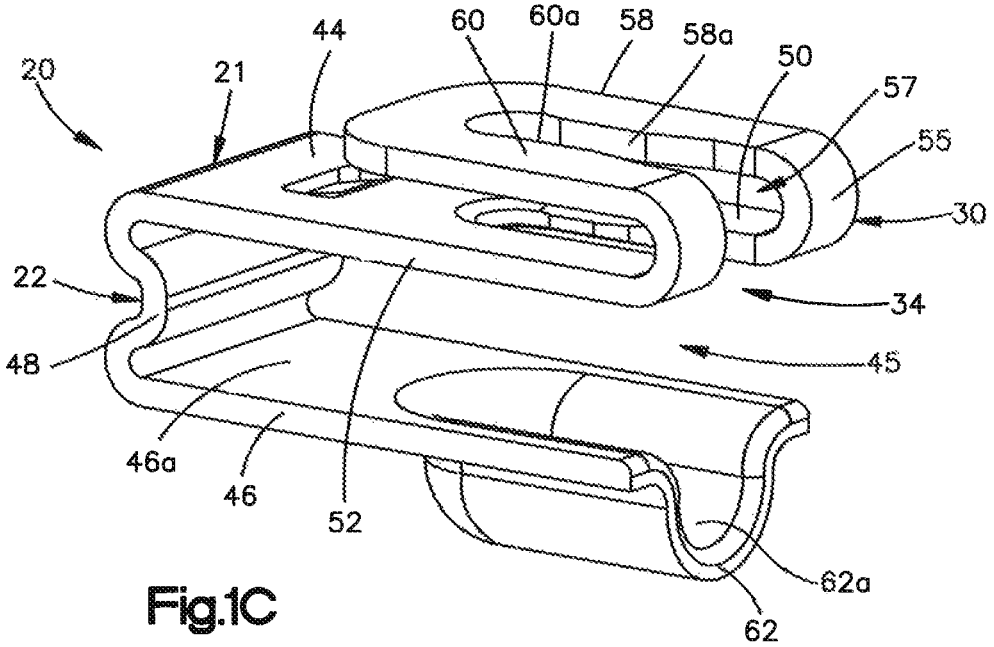
FIG. 1C is another perspective view of the insulation displacement connector illustrated in FIG. 1A.
Figure 1D:
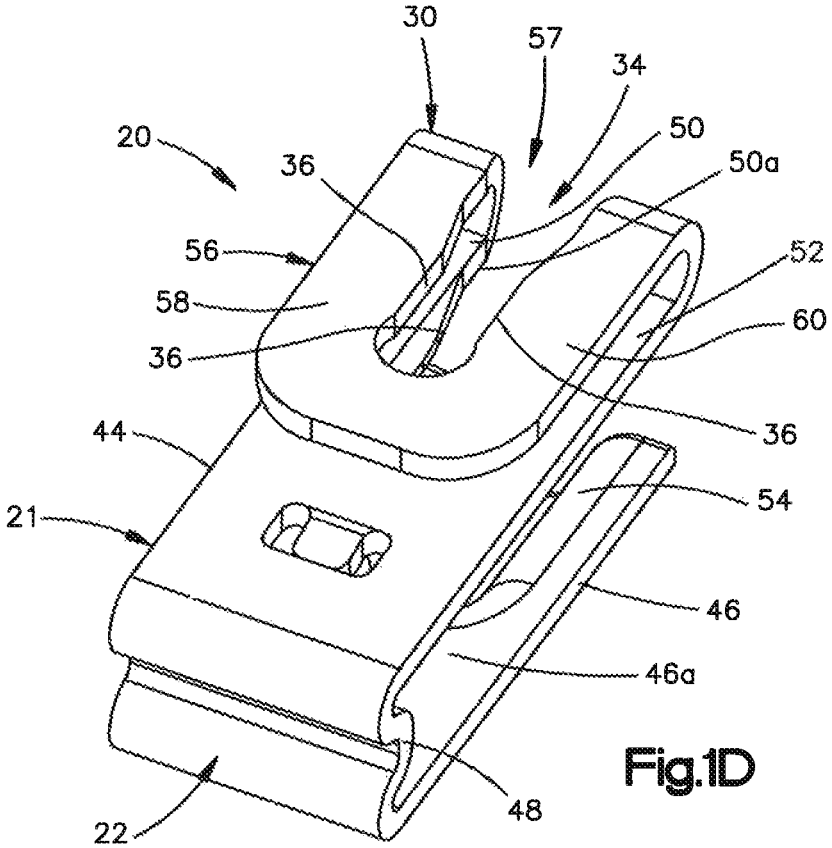
FIG. 1D is another perspective view of the insulation displacement connector illustrated in FIG. 1A.
Figure 1E:
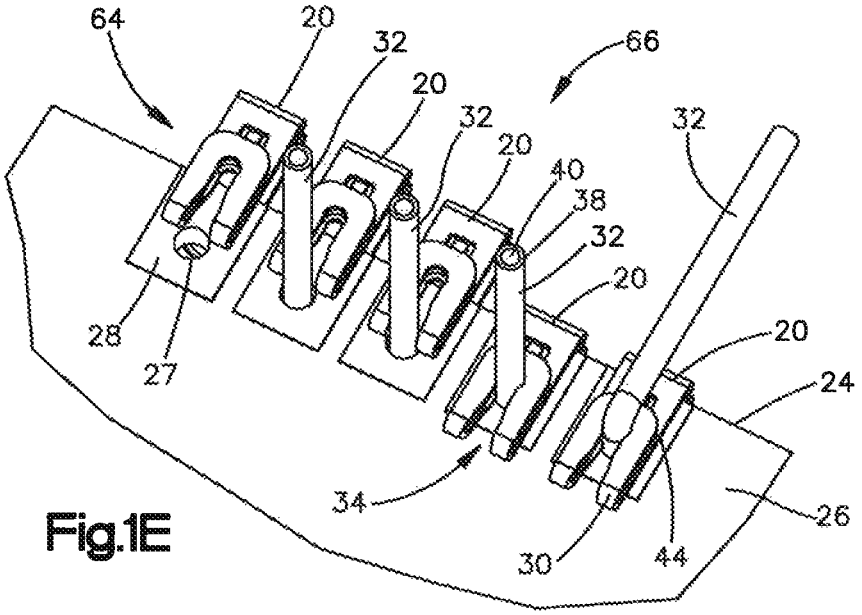
FIG. 1E is a top perspective view of an insulation displacement connector, including a plurality of insulation displacement contacts illustrated in FIGS. 1A-B, shown mated to a printed circuit board, and shown at different stages of attachment to a respective complementary electrical cable.
Figure 1F:
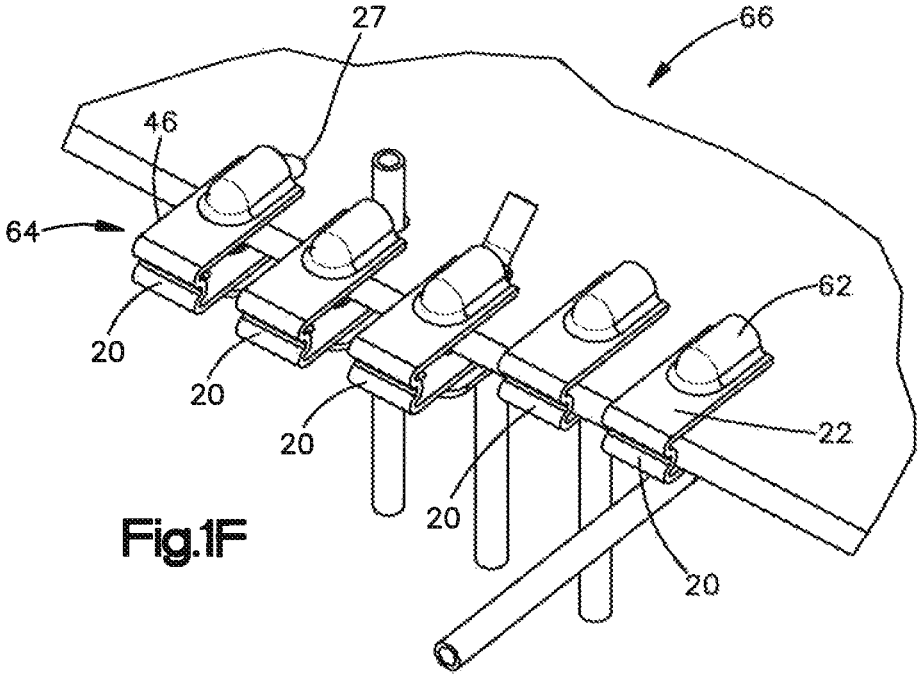
FIG. 1F is a bottom perspective view of the insulation displacement connector illustrated in FIG. 1E.
Figure 1G:
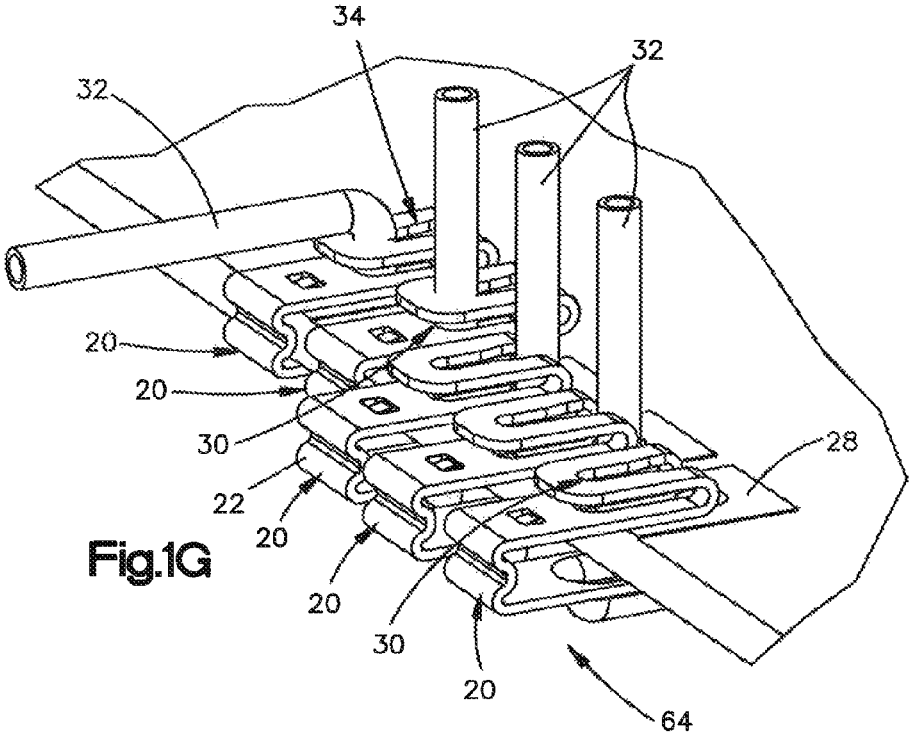
FIG. 1G is an enlarged top perspective view of the insulation displacement connector illustrated in FIG. 1E.
Figure 1H:
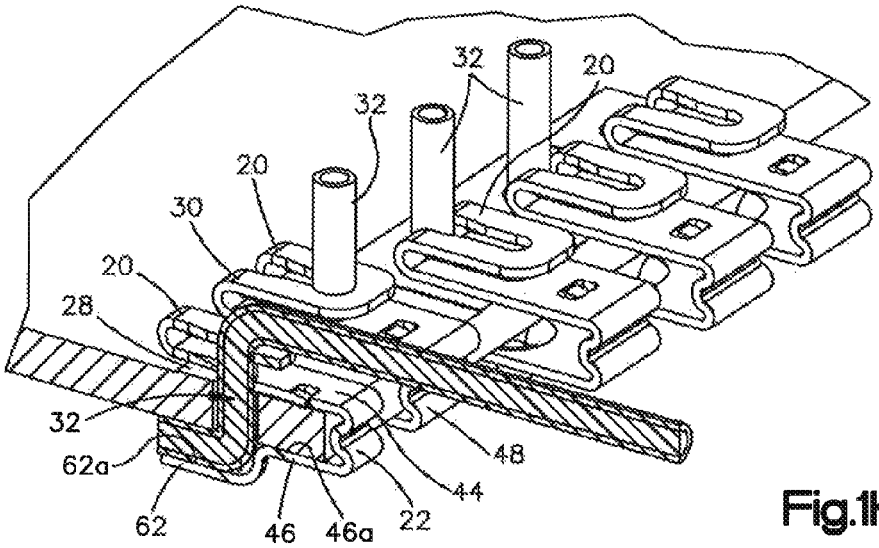
FIG. 1H is a sectional perspective view showing one of the insulation displacement contacts of the insulation displacement connector illustrated in FIG. 1G shown fully attached to a respective electrical cable.
Figure 2A:
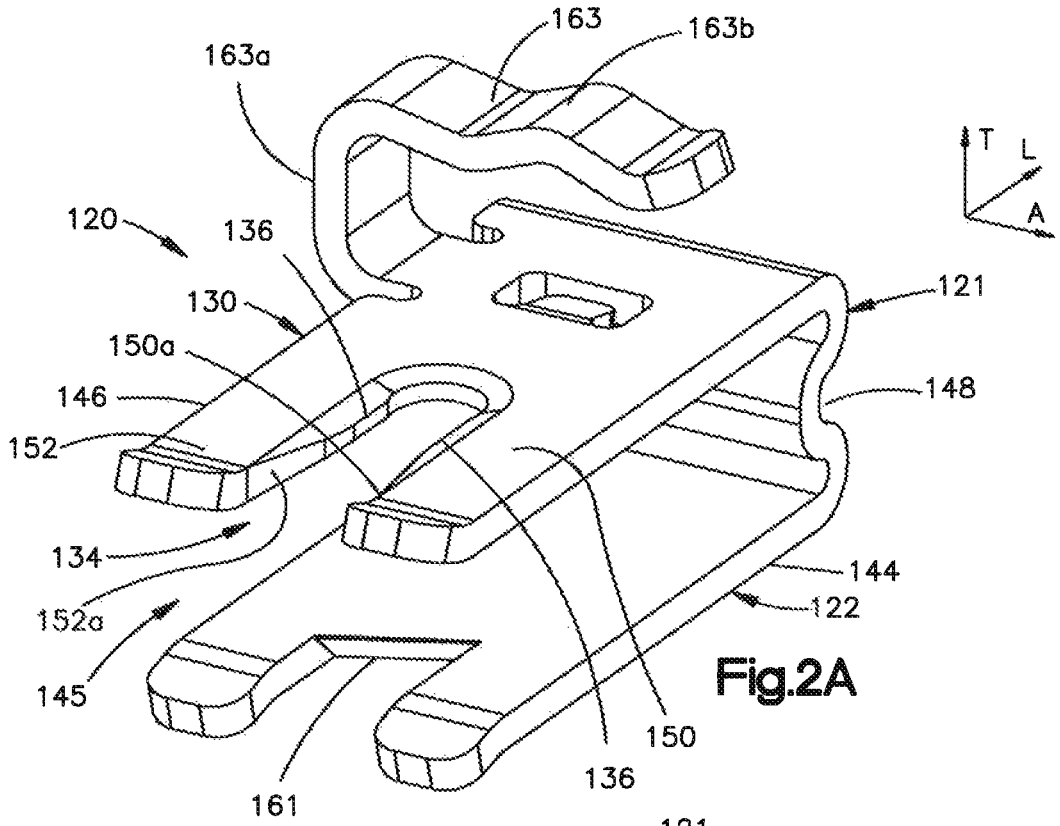
FIG. 2A is a perspective view of an insulation displacement contact constructed in accordance with another embodiment.
Figure 2B:
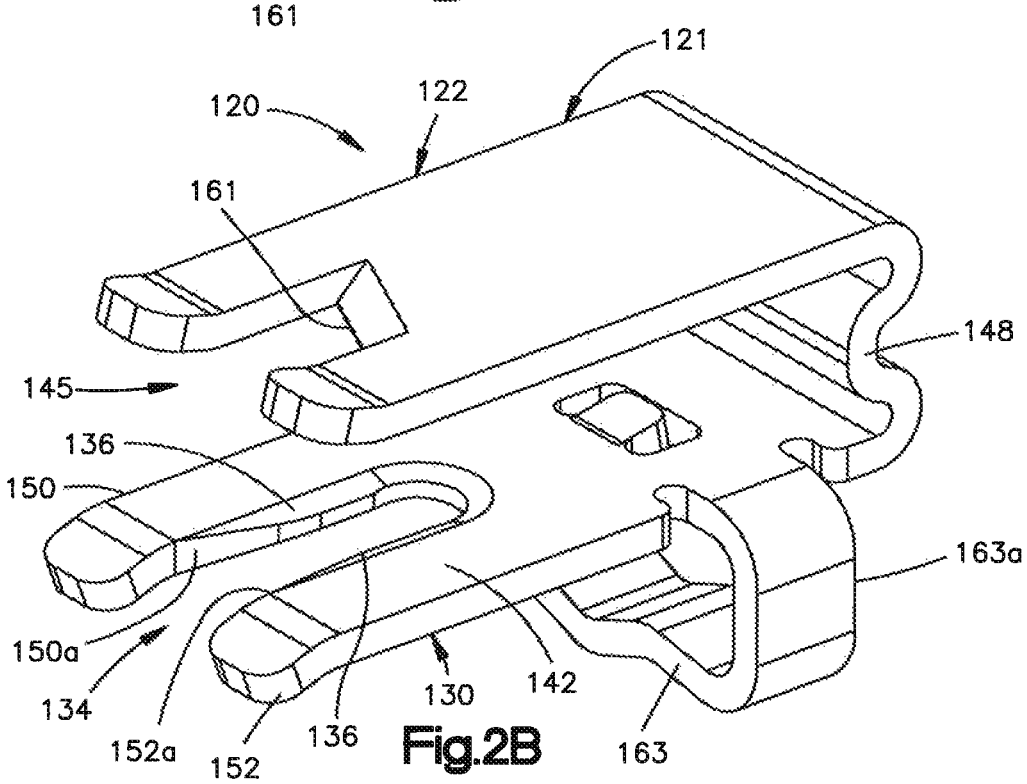
FIG. 2B is another perspective view of the insulation displacement contact illustrated in FIG. 2A.
Figure 2C:
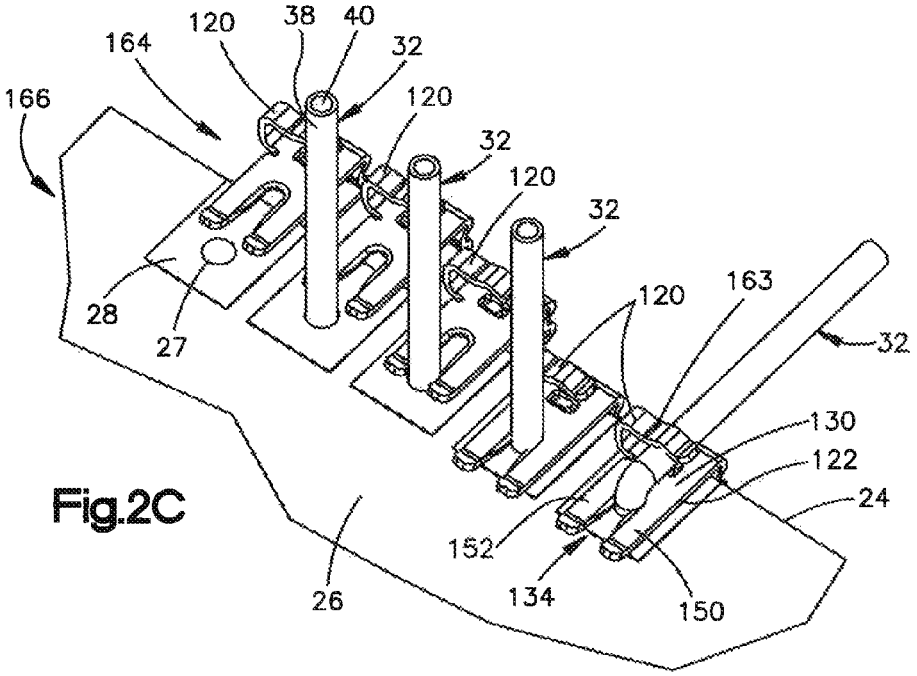
FIG. 2C is a top perspective view of an insulation displacement connector, including a plurality of insulation displacement contacts illustrated in FIGS. 2A-B, shown mated to a printed circuit board, and shown at different stages of attachment to a respective complementary electrical cable.
Figure 2D:
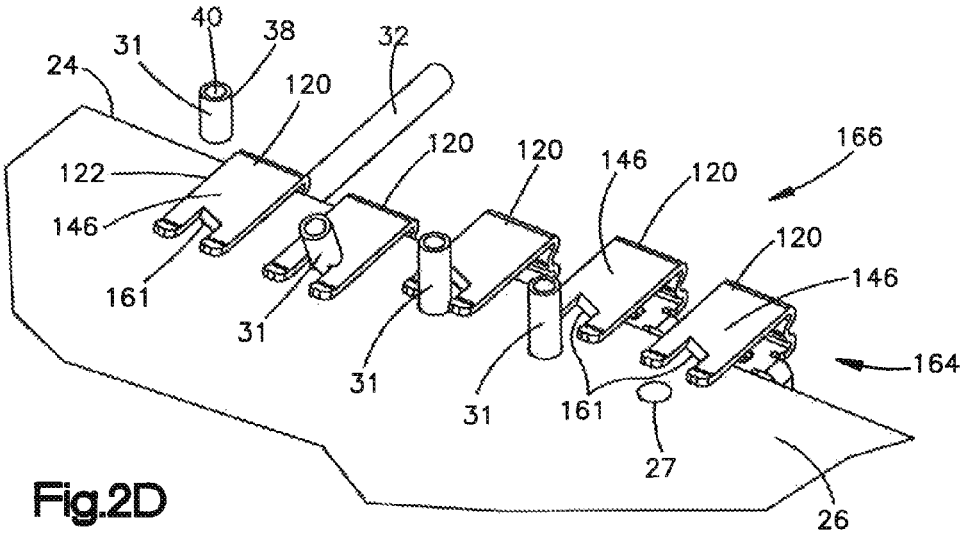
FIG. 2D is a bottom perspective view of the insulation displacement connector illustrated in FIG. 2C.
Figure 2E:
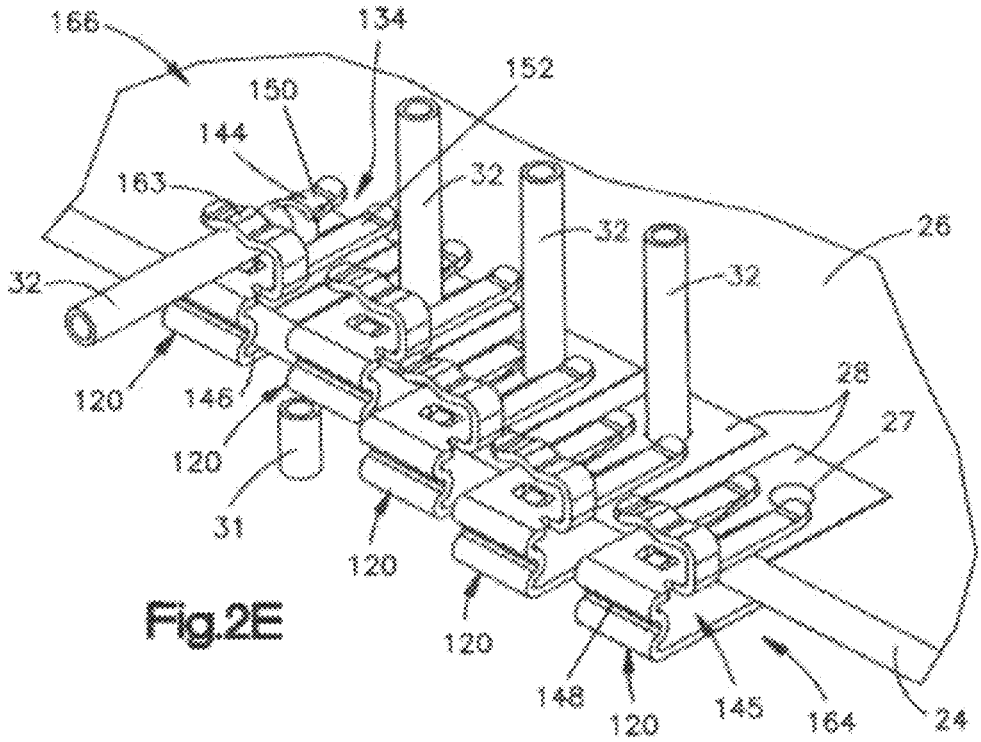
FIG. 2E is another top perspective view of the insulation displacement connector illustrated in FIG. 2C, after one of the electrical cables has been severed.
Figure 2F:
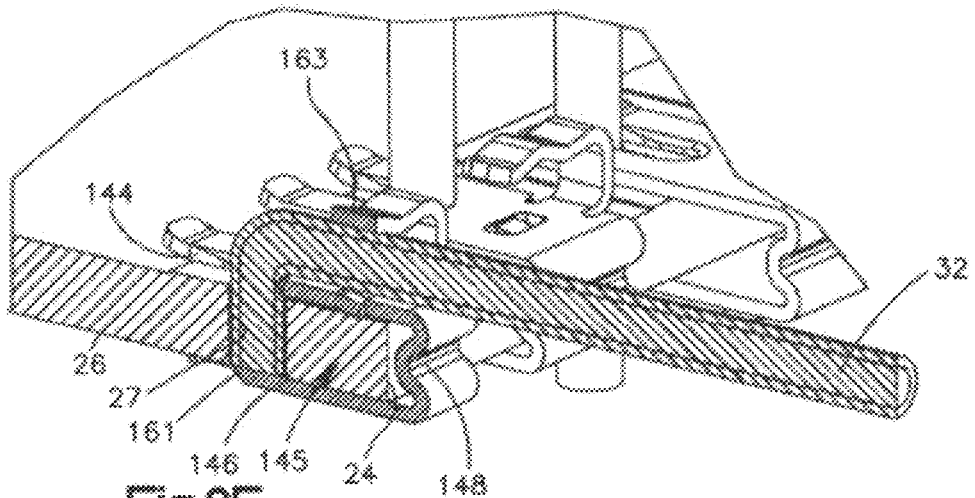
FIG. 2F is a sectional perspective view showing one of the insulation displacement contacts of the insulation displacement connector illustrated in FIG. 2C shown fully attached to a respective electrical cable.
Figure 3A:
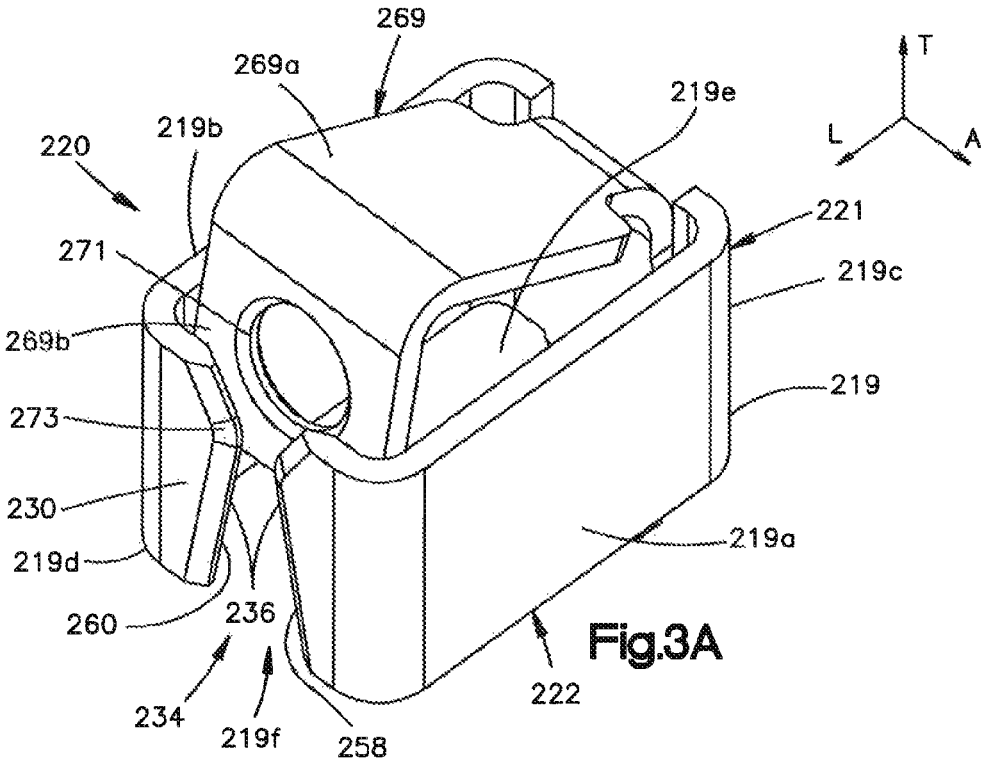
FIG. 3A is a perspective view of an insulation displacement contact constructed in accordance with another embodiment.
Figure 3B:
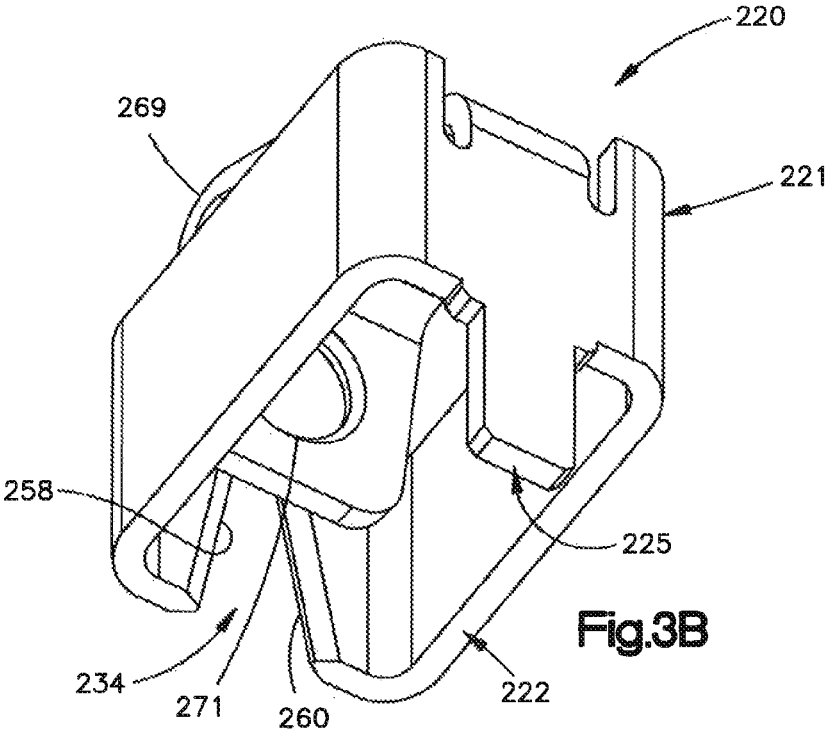
FIG. 3B is another perspective view of the insulation displacement contact illustrated in FIG. 3A.
Figure 3C:
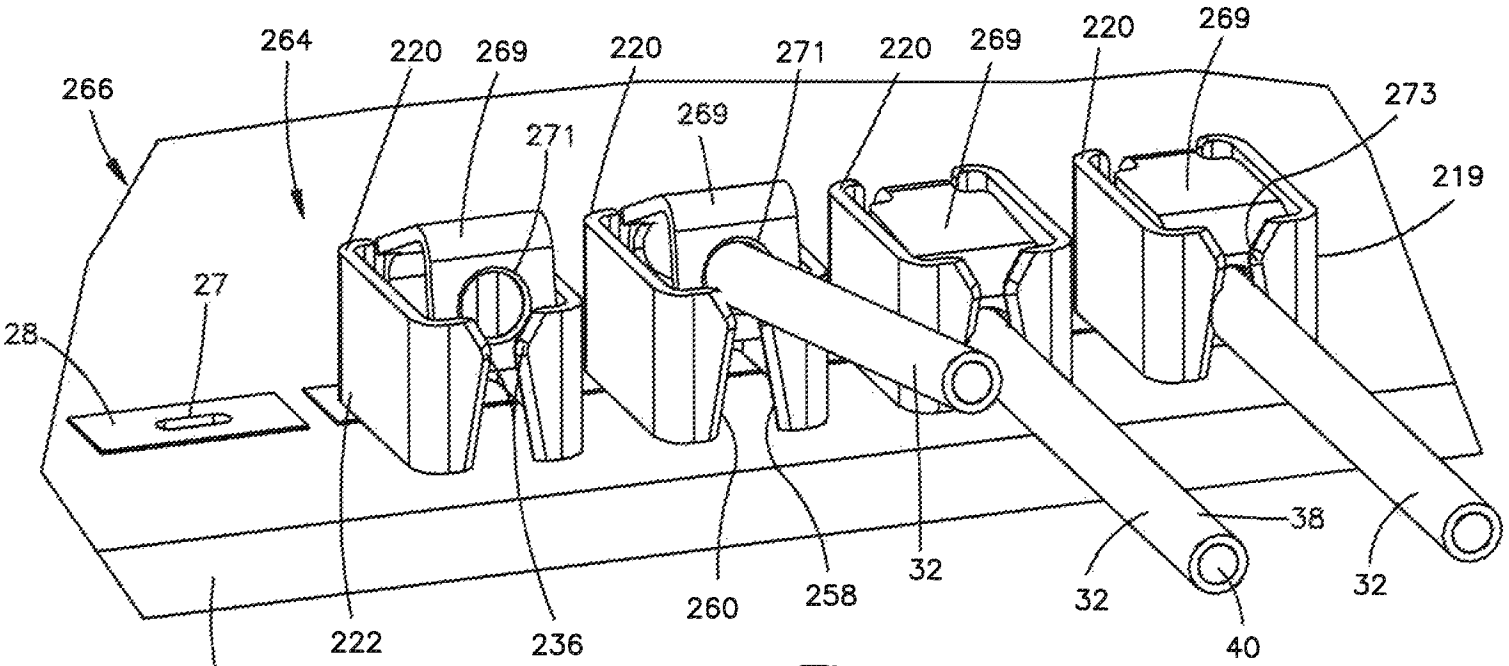
FIG. 3C is a perspective view of a plurality of the insulation displacement contacts illustrated in FIGS. 3A-B shown mounted to a printed circuit board, and shown at different stages of attachment to a respective complementary electrical cable.
Figure 3D:
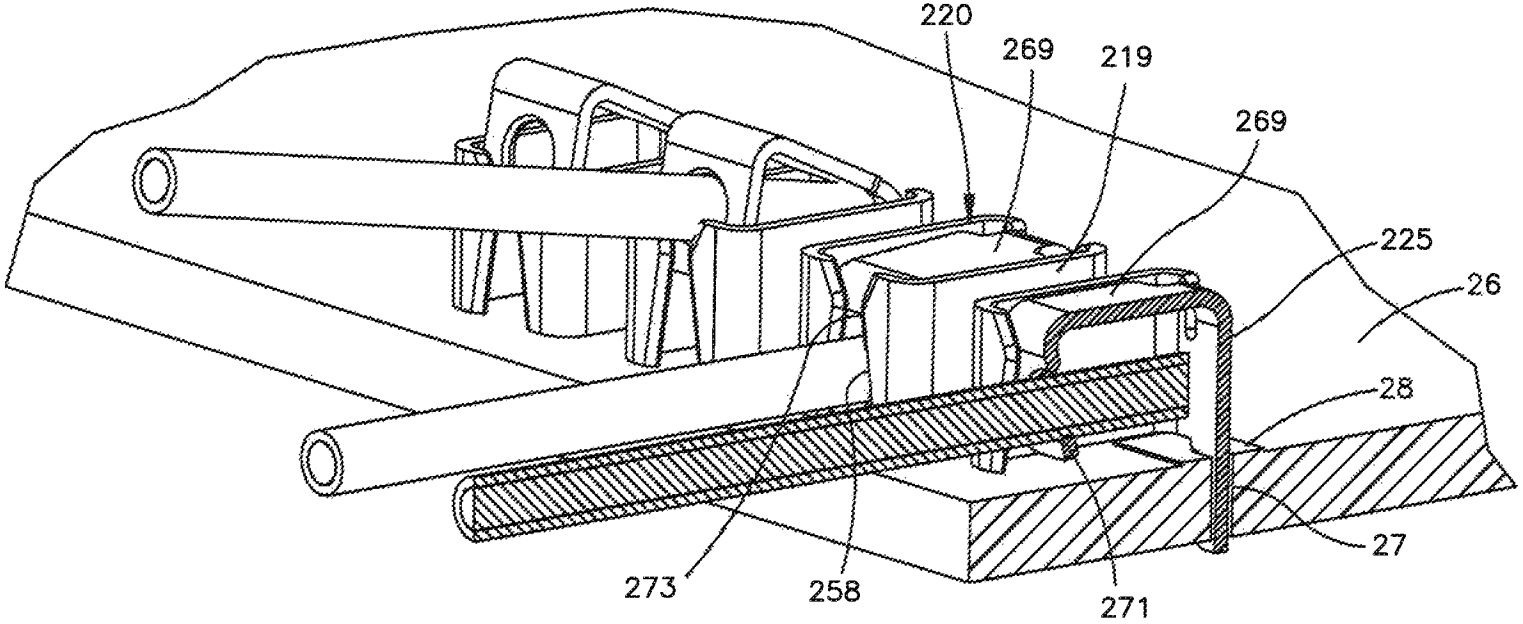
FIG. 3D is a sectional perspective view showing one of the insulation displacement contacts of the insulation displacement connector illustrated in FIG. 3C shown fully attached to a respective electrical cable.
Figure 4A:
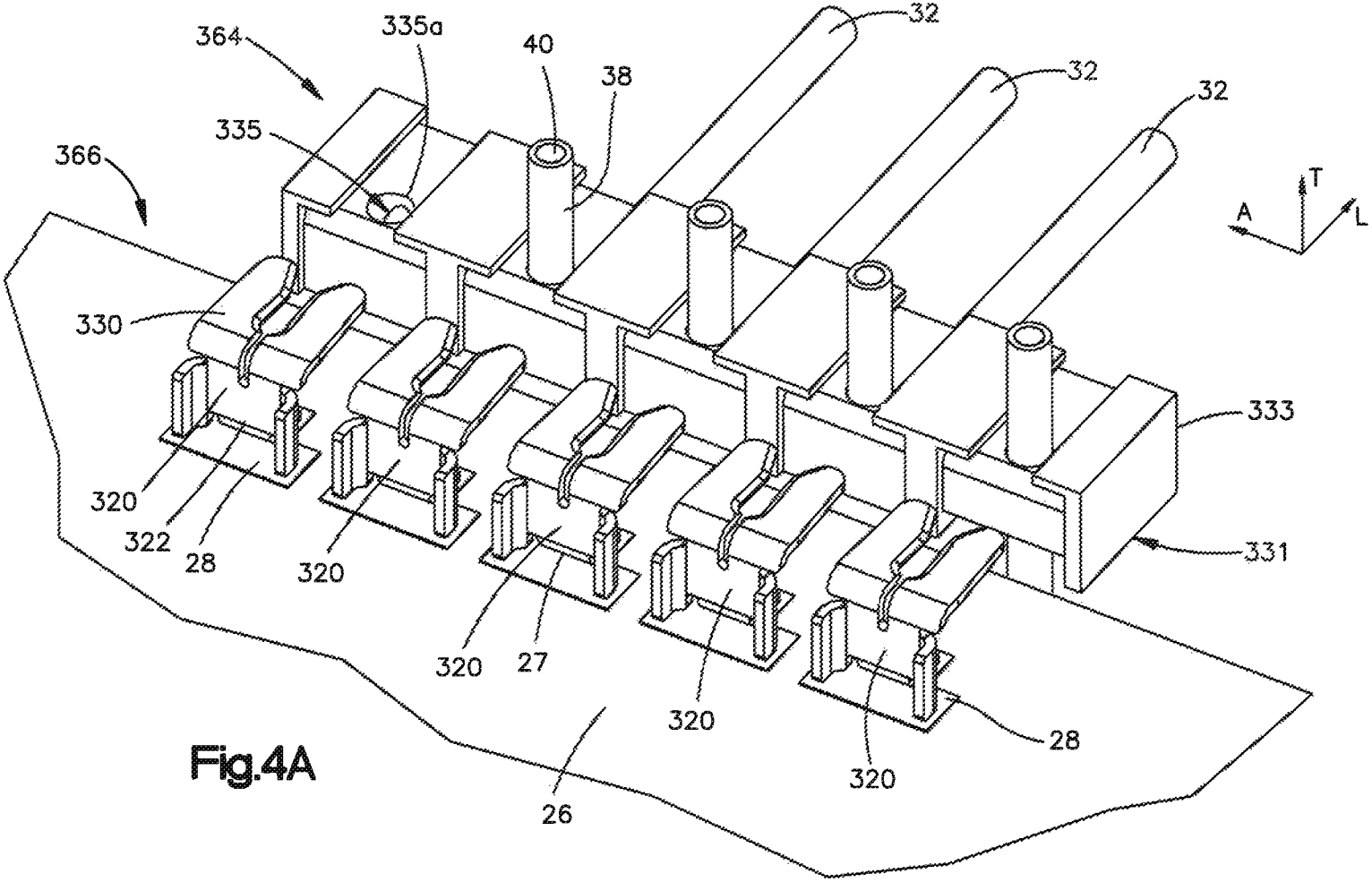
FIG. 4A is a perspective view of an electrical connector assembly constructed in accordance with another embodiment, including a printed circuit board, a plurality of cables, an insulation displacement contact configured to be mounted to the printed circuit board, and a connector housing that retains the cables, the connector housing configured to attach the cables to the insulation displacement contact.
Figure 4B:
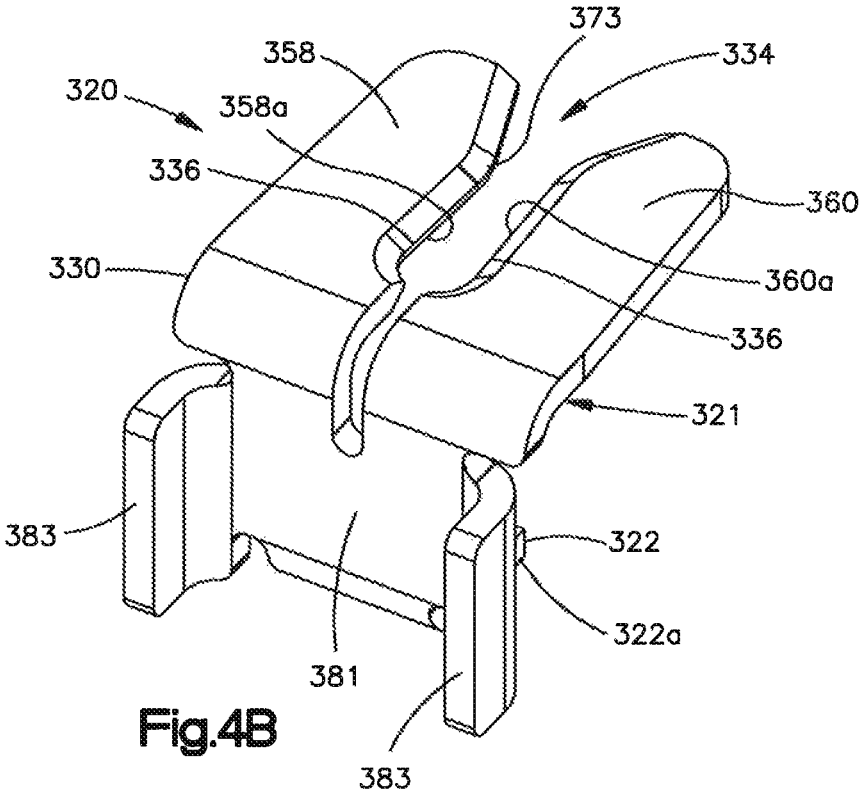
FIG. 4B is a perspective view of an insulation displacement contact illustrated in FIG. 4A.
Figure 4C:
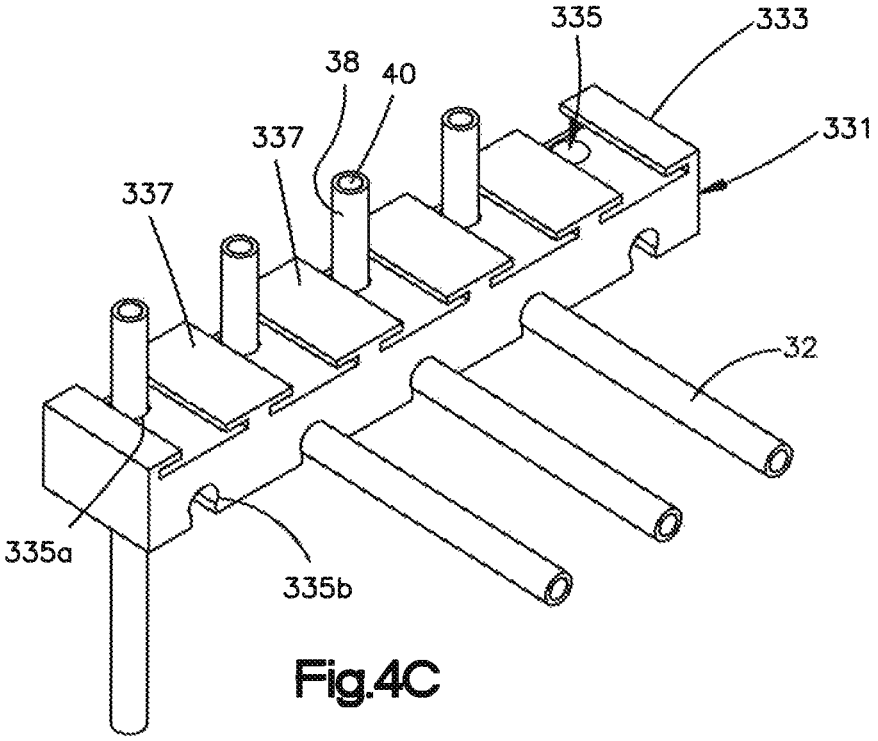
FIG. 4C is a perspective view of electrical cables inserted in the connector housing.
Figure 4D:
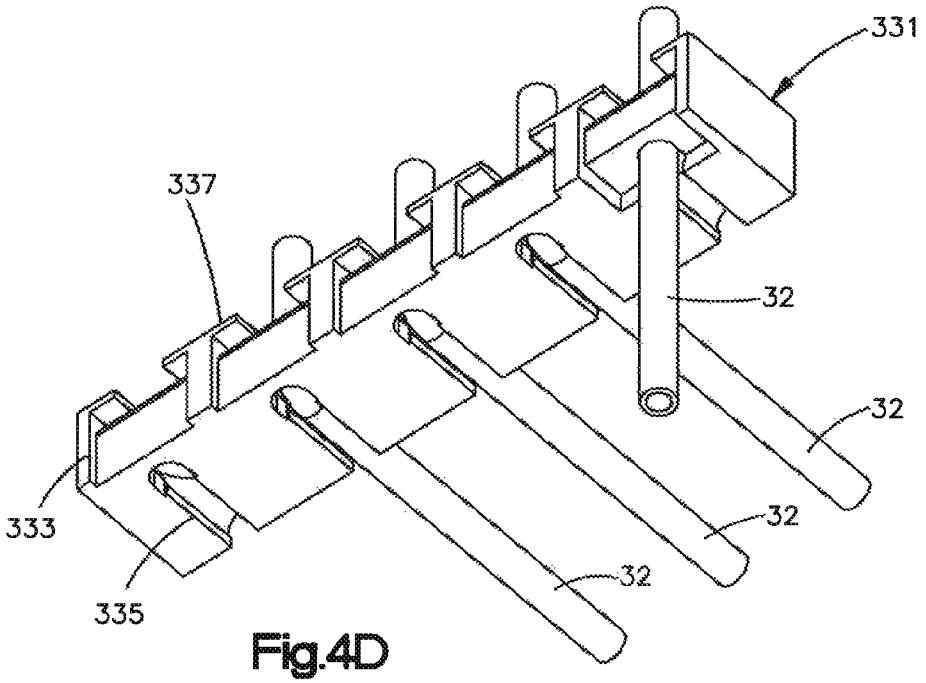
FIG. 4D is a perspective view of electrical cables inserted in the connector housing.
Figure 4E:
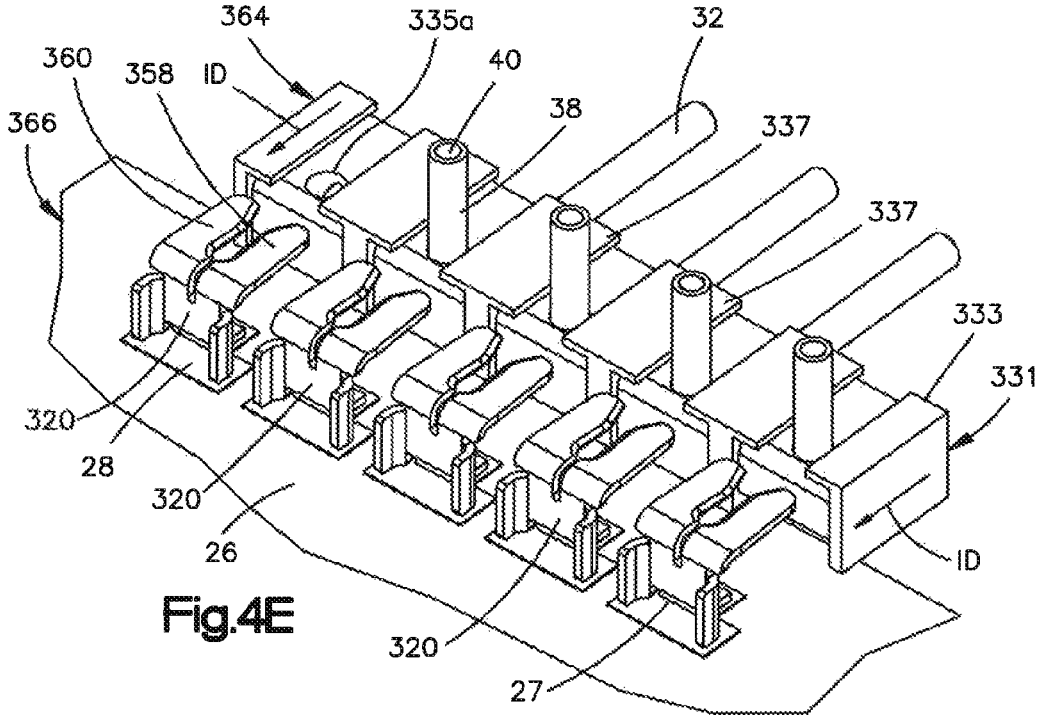
FIG. 4E is a perspective view of the electrical connector assembly illustrated in FIG. 4A, showing the connector housing attaching the electrical cables to the insulation displacement contacts.
Figure 4F:
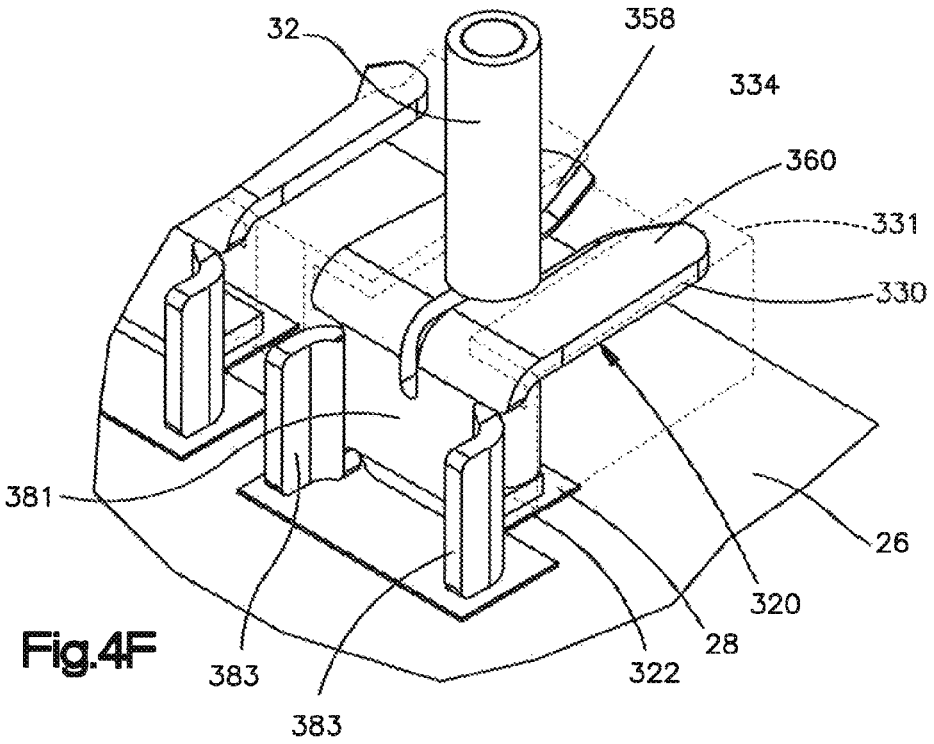
FIG. 4F is an enlarged perspective view of one of the insulation displacement contact illustrated in FIG. 4A, but including stabilizers in accordance with an alternative embodiment.
Figure 5A:
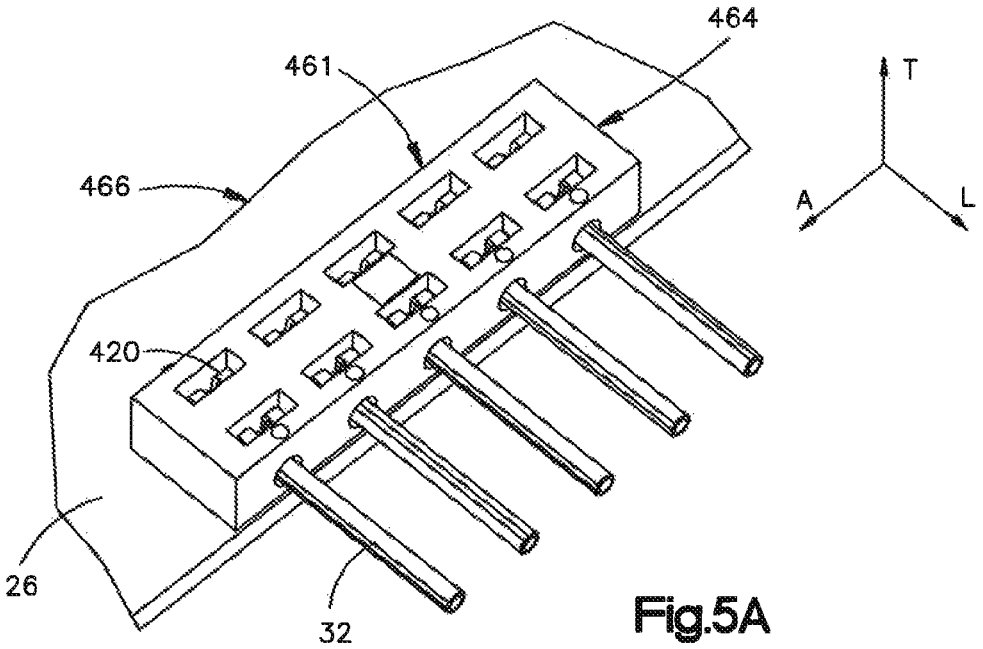
FIG. 5A is a perspective view of an electrical connector assembly constructed in accordance with another embodiment, including a printed circuit board, a plurality of cables, a plurality of insulation displacement contacts configured to be mounted to the printed circuit board, and a connector housing that retains the cables, the connector housing configured to attach the cables to the insulation displacement contact.
Figure 5B:
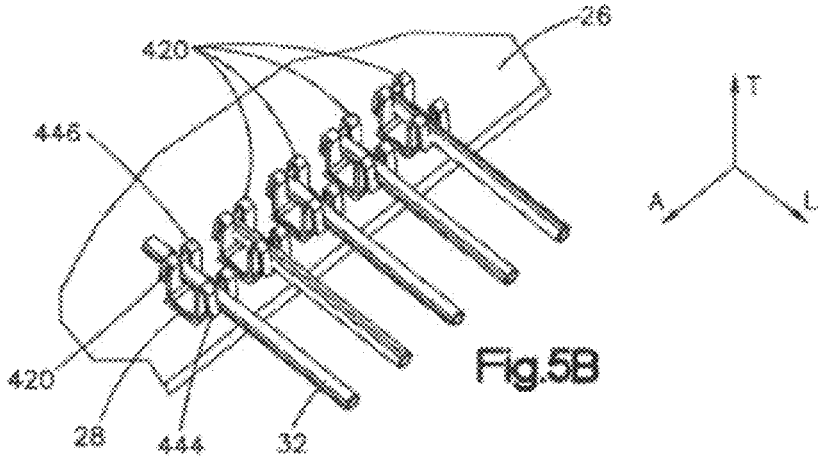
FIG. 5B is a perspective view of the plurality of insulation displacement contacts illustrated in FIG. 5A shown mounted to the printed circuit board and attached to the electrical cables.
Figure 5C:
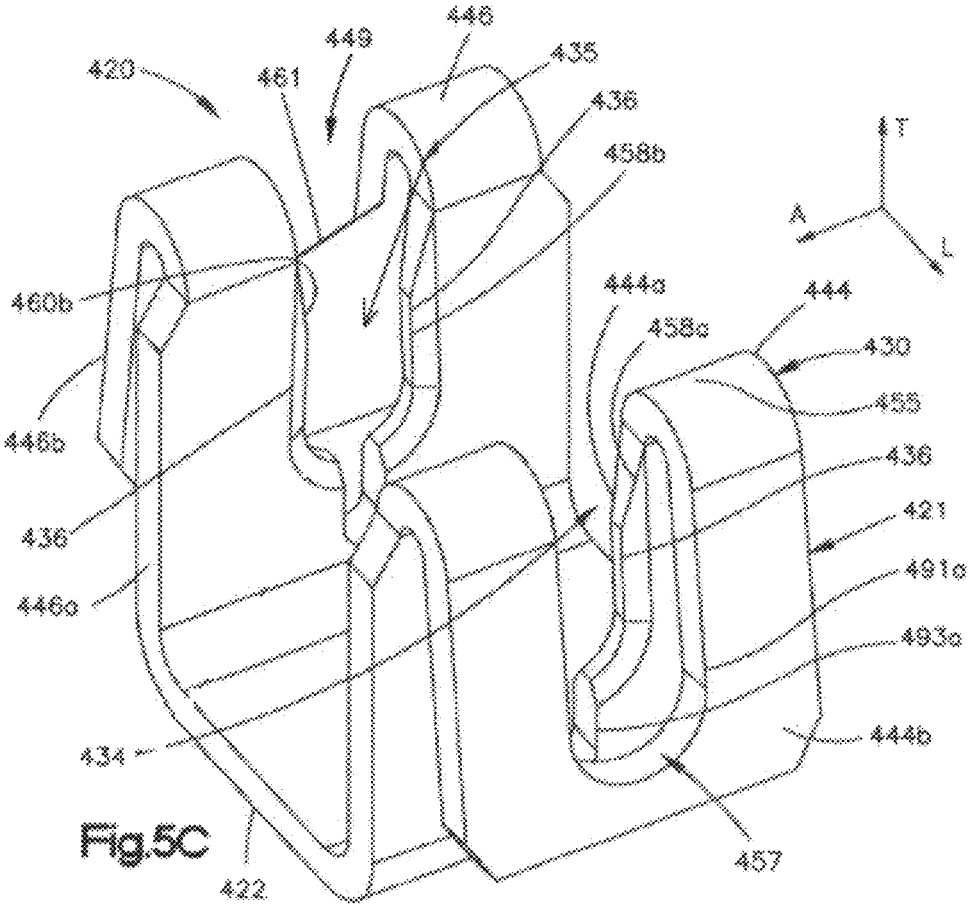
FIG. 5C is a perspective view of one of the insulation displacement contacts illustrated in FIG. 5B.
Figure 5D:
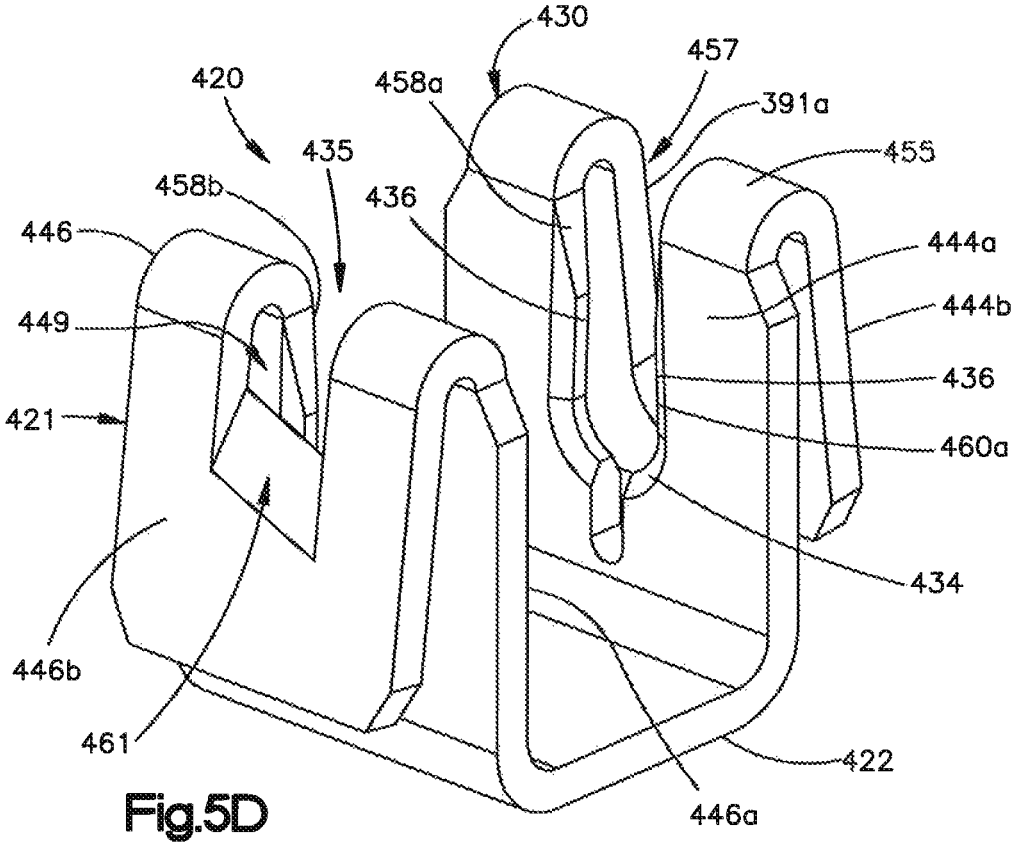
FIG. 5D is another perspective view of one of the insulation displacement contacts illustrated in FIG. 5B.
Figure 5E:
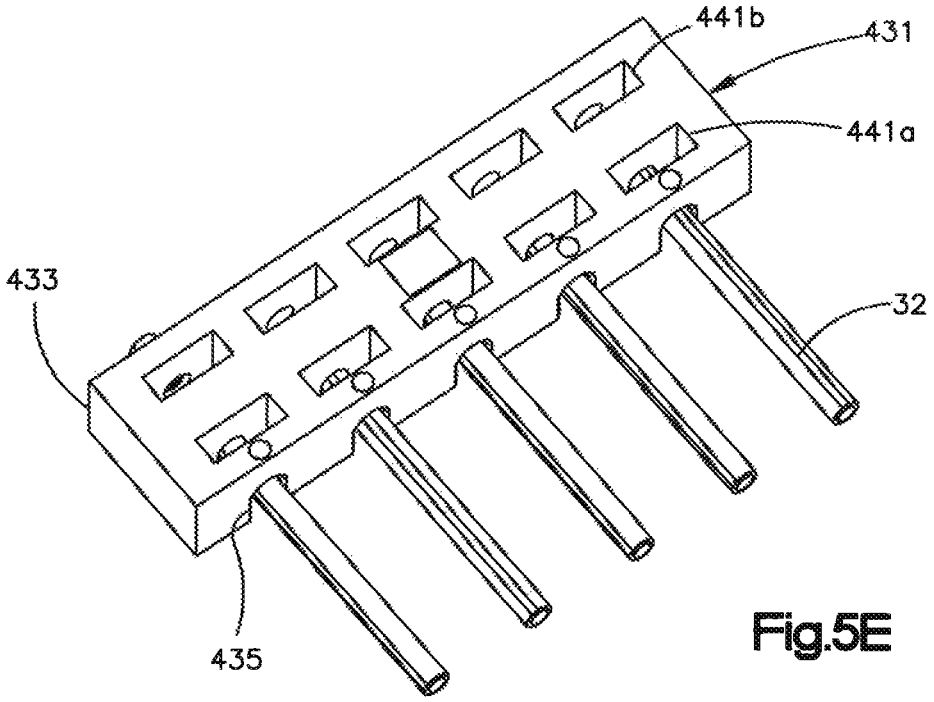
FIG. 5E is a perspective view of the connector housing illustrated in FIG. 5A, shown retaining the electrical cables.
Figure 5F:
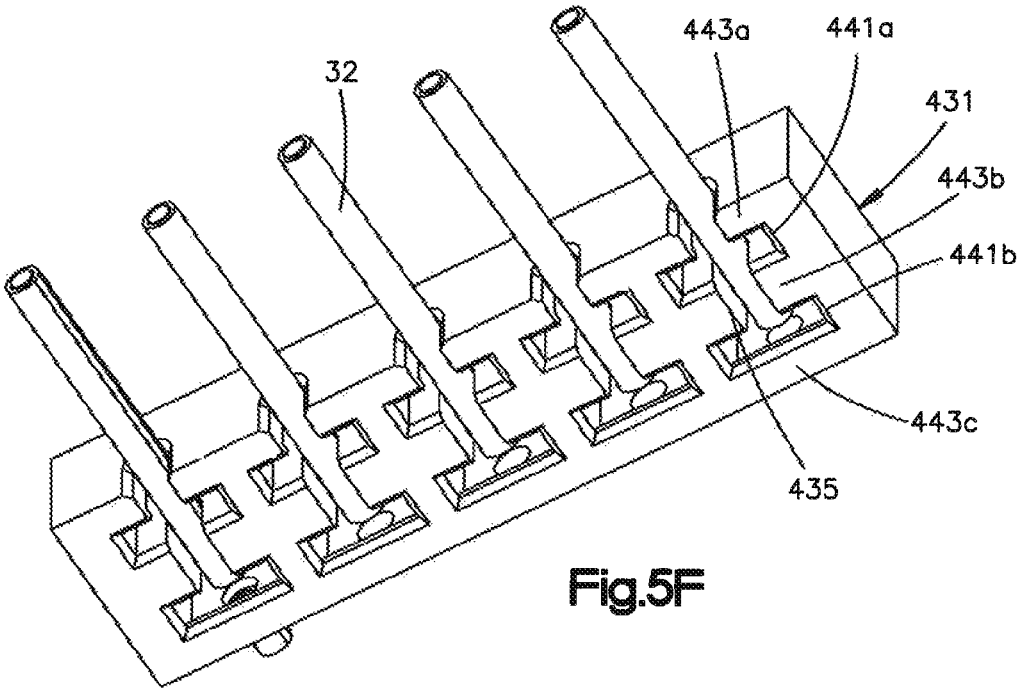
FIG. 5F is another perspective view of the connector housing illustrated in FIG. 5A, shown retaining the electrical cables.
Figure 5G:
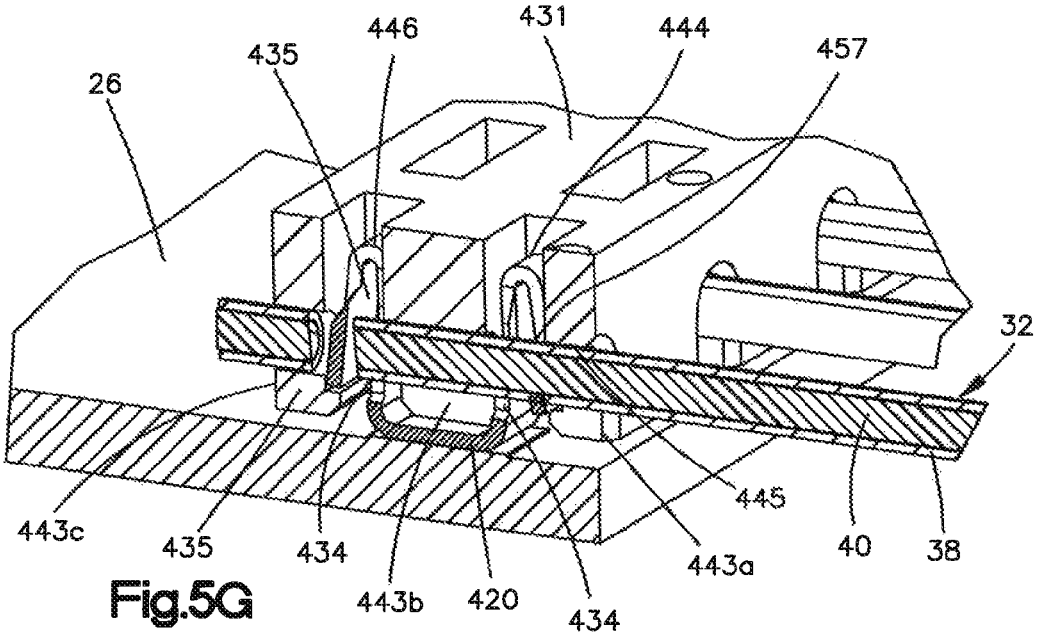
FIG. 5G is a sectional perspective view of the electrical connector assembly illustrated in FIG. 5A.
Figure 5H:
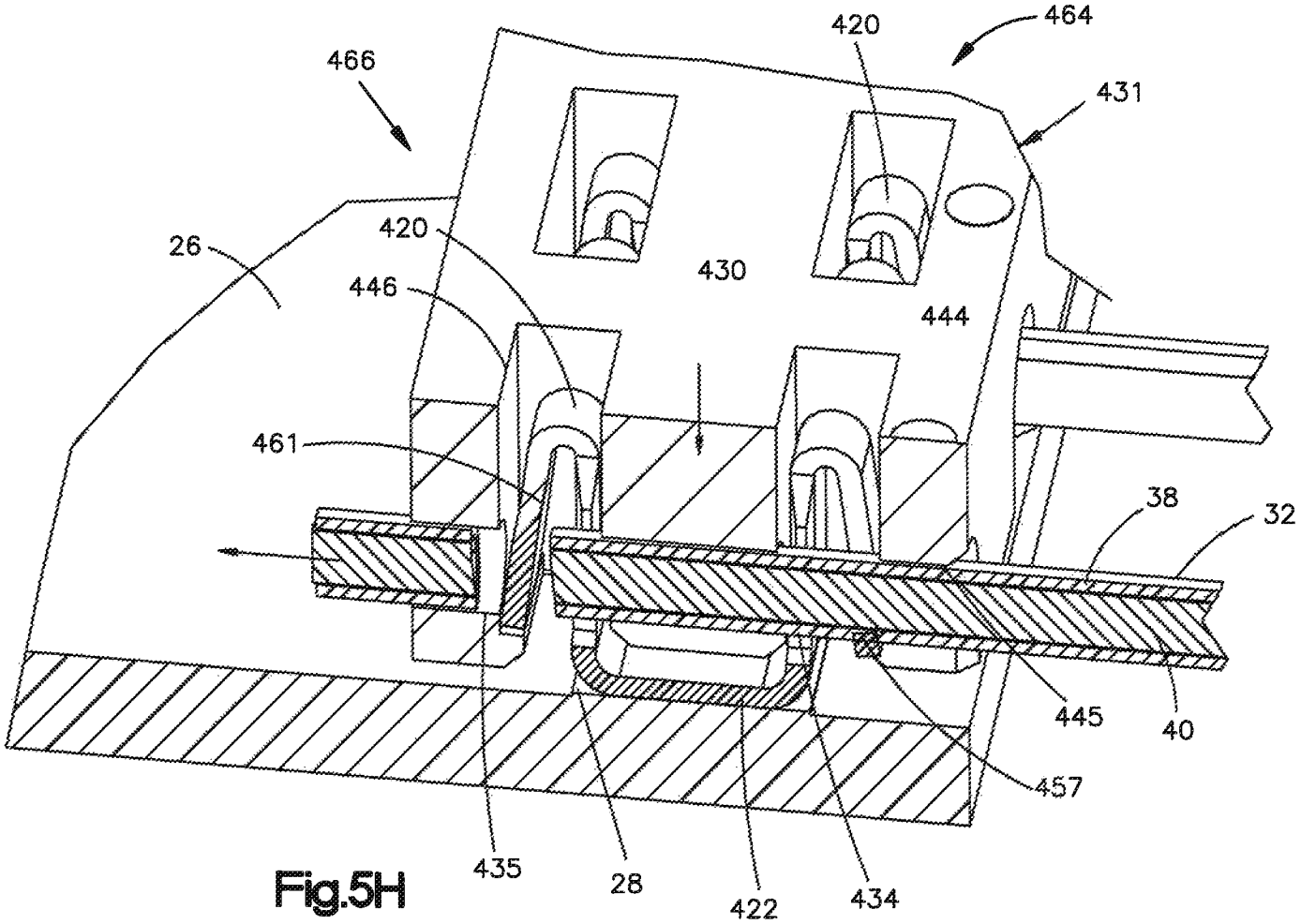
FIG. 5H is a sectional perspective view of the electrical connector assembly illustrated in FIG. 5A.
Figure 5J:
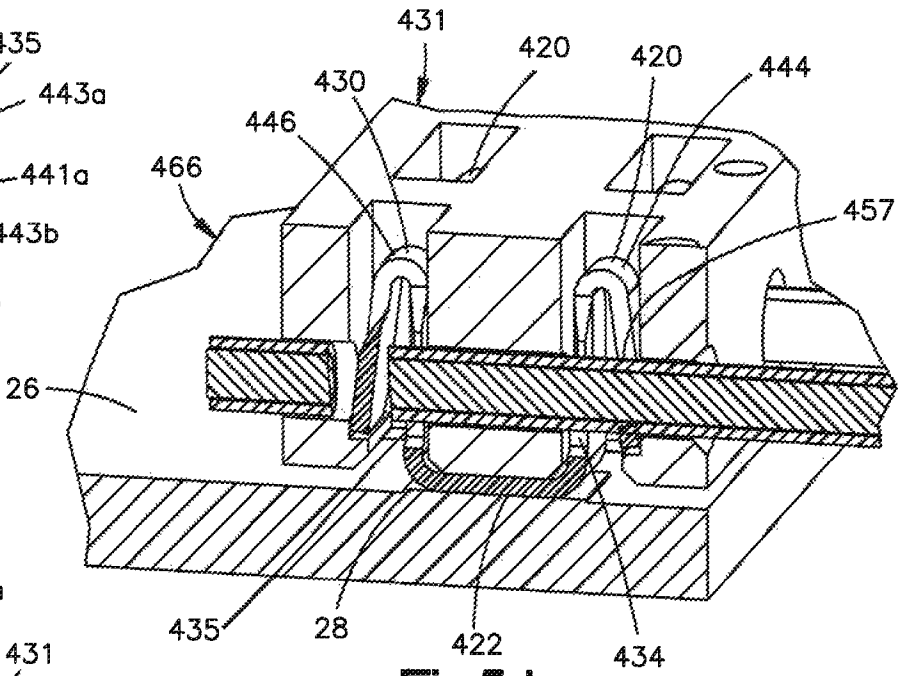
FIG. 5J is a sectional perspective view of the electrical connector assembly illustrated in FIG. 5A, but showing the connector housing constructed in accordance with an alternative embodiment.
Figure 5I:
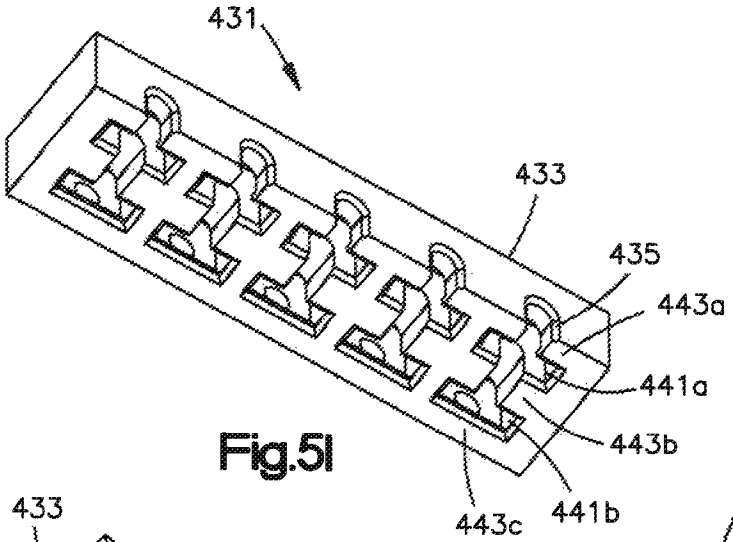
FIG. 5I is a perspective view of the connector housing illustrated in FIGS. 5E-F.
Figure 5K:
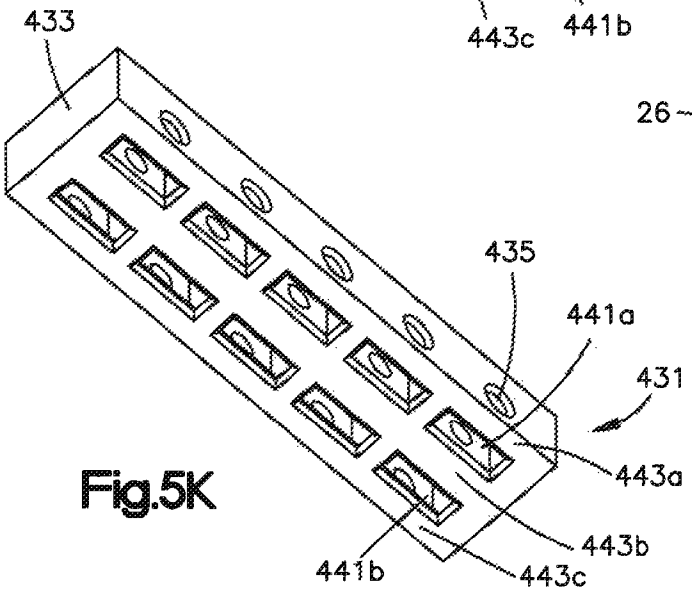
FIG. 5K is a perspective view of the connector housing illustrated in FIG. 5J.

Referring to FIGS. 1A-1H, an insulation displacement contact 20, and all insulation displacement contacts described herein, can be made from any suitable electrically conductive material, such as a metal. The insulation displacement contact 20 includes an electrically conductive contact body 21 that, in turn, includes a mounting portion 22 that is configured to receive an edge 24 of a complementary electrical component 26, such as a printed circuit board, so as to contact a respective electrical terminal 28, such as a contact pad, of the complementary electrical component 26. The complementary electrical component 26, and all complementary electrical components described herein, can be a printed circuit board or any suitable constructed alternative electrical component 26. The electrically conductive contact body 21 further includes a mating portion 30 that is configured to attach to an electrical cable 32. The mating portion 30 can be monolithic with the mounting portion 22. The mating portion 30 can include a slot 34 that extends into the contact body 21, and at least one piercing member 36 that at least partially defines the slot 34 such that, when the slot 34 receives the electrical cable 32, the piercing member 36 pierces an outer electrically insulative layer 38 of the electrical cable 32 and contacts an electrical conductor 40 of the electrical cable 32 that is disposed inside the outer electrically insulative layer 38. It should be appreciated that the slot 34 can have a width of zero along the lateral direction A before the electrical cable 32 is inserted into the slot. Once the electrical cable 32 has been inserted into the slot, the slot 34 can define a width greater than zero. Alternatively, the slot 34 can have a width greater than zero before and after the cable 32 has been inserted into the slot 34.

The mounting portion 22 defines a contact surface 42 that is configured to contact the electrical terminal 28 of the complementary electrical component 26, so as to place the electrical terminal 28 in electrical communication with the mounting portion 22, and thus the mating portion 30. The mounting portion 22 defines first and second arms 44 and 46 that are spaced from each other along a transverse direction T so as to define a gap 45 therebetween, the gap 45 sized to receive the edge 24 of the complementary electrical component 26 as the mounting portion 22 moves along a mounting direction relative to the complementary electrical component 26. The mounting direction can be defined by a forward direction along a longitudinal direction L that is substantially perpendicular, such as angularly offset, and in one example perpendicular, with respect to the transverse direction T. Thus, the transverse direction T is substantially perpendicular to the mounting direction. As used herein, the phrase "substantially perpendicular" can refer to angularly offset, and in one example perpendicular, unless otherwise indicated.

The slot 34 extends 1) through the first arm 44 along the transverse direction T, and 2) into the first arm 44 in a direction, such as a rearward direction, opposite the forward mounting direction, along the longitudinal direction L. Both the gap 45 and the slot 34 are both forward facing and open in the mounting direction. The slot 34 has an open first end that faces a direction opposite the mounting direction, and a closed second end opposite the first end and spaced from the first end in the mounting direction. Further, the open first end of the slot 34 is spaced from the closed end of the slot 34 along a mating direction that attaches the mating portion 30 to the electrical cable 32. The mating direction can be the same as the mounting direction, and can be defined by moving the insulation displacement contact 20 toward the electrical cable 32, or by moving the electrical cable 32 toward the insulation displacement contact, such that relative motion of the insulation displacement contact 20 with respect to the electrical cable 32 is in the mating direction. The contact body 21 can define a joint 48 that is connected between the first and second arms, such that a mouth of the gap 45 is spaced from the joint 48 in the mounting direction. The joint 48 can thus close the rear end of the gap 45. The front end of the gap 45 is open so as to receive the edge 24 of the complementary electrical component 26 as the insulation displacement contact 20 is mounted onto the complementary electrical component 26 along the mounting direction. The joint 48 can be substantially linear, curved, or can define any shape as desired. The joint 48 can be flexible and resilient so as to allow one or both of the first and second arms 44 and 46 to resiliently flex with respect to the other of the first and second arms 44 and 46. Thus, at least one of the first and second arms 44 and 46 is flexible with respect to the other of the first and second arms 44 and 46 about the joint 48.

The first arm 44 can include a pair of fingers 50 and 52 having respective opposed inner surfaces 50*a* and 52*a* that are spaced from each other so as to at least partially define the slot 34. For instance, the inner surfaces 50*a* and 52*a* can be spaced from each other along a lateral direction A that is substantially perpendicular to both the longitudinal direction L and the transverse direction T. The inner surfaces 50*a* and 52*a* can be tapered toward each other along a direction from the open first end toward the closed second end, or can be substantially parallel to each other, or can define any shape as desired. The inner surface of at least one of the fingers 50 and 52 includes the piercing member 36. The mating portion 30 defines a first distance from the piercing member 36 to the opposed inner surface across the slot 34 along the lateral direction A. The first distance is less than an outer dimension, which can be a diameter, of the electrical cable 32. For instance, the first distance can be less than an outer dimension, such as an outer diameter, of the outer electrically insulative layer 38, can further be less than an inner dimension, such as an inner diameter, of the outer electrically insulative layer 38, and can further be less than an outer dimension, such as a diameter, of the electrical conductor 40. Thus, when the insulation displacement contact 20 receives the electrical cable 32 along the mating direction, the cable 32, and a plurality of differently sized electrical cables, can be individually received in the slot 34 such that the piercing member 36 pierces through the outer electrically insulative layer 38 and contacts the electrical conductor 40. Each of the inner surfaces 50*a* and 52*a* can define a respective piercing member 36. For instance, the piercing member 36 can define a blade surface that slices through the electrically insulative layer 138 into the electrical conductor 40.

The first arm 44 can define a first portion 54 and a second portion 56, such that the first portion 54 includes the pair of fingers 50 and 52. For instance, the first arm 44 can define a bent region 55 that is bent substantially 180 degrees so as to define the first and second portions 54 and 56. The bent region 55 can be substantially u-shaped or alternatively shaped as desired. The first portion 54 of the first arm 44 is disposed between the second portion 56 of the first arm 44 and the second arm 46 along the transverse direction T. The first portion 54 defines the slot 34, which can be a first slot, and the second portion 56 can define a second slot 57 that is aligned with the first slot 34 along the transverse direction T. It should be appreciated that the second slot 57 can have a width of zero along the lateral direction A before the electrical cable 32 is inserted into the slot. Once the electrical cable 32 has been inserted into the second slot 57, the second slot 57 can define a width greater than zero. Alternatively, the second slot 57 can have a width greater than zero before and after the cable 32 has been inserted into the second slot 57. Unless otherwise indicated, as described herein, in accordance with all embodiments, alignment of elements along a given direction means that a straight line extending along the given direction can extend through, for instance centrally through, the elements. In accordance with the illustrated embodiment, the second portion 56 includes a pair of fingers 58 and 60 that, in turn, defines respective inner surfaces 58*a* and 60*a* that are spaced from each other so as to at least partially define the second slot 57. The slot 34 can be continuous with the second slot 57, the first fingers of the slots 34 and 56 can be continuous with each other, and the second fingers of the slots 34 and 56 can be continuous with each other. For instance, the first and second fingers can define the bent region 55.

The inner surfaces 58*a* and 60*a* can be spaced from each other along the lateral direction A. The inner surfaces 58*a* and 60*a* can be tapered toward each other along a direction from an open first end of the second slot 57 toward a closed second end of the slot, can be substantially parallel to each other, or can define any shape as desired. The inner surfaces 58*a* and 60*a* are opposite each other so as to define the second slot 57. The fingers 58 and 60 define a second distance that extends from one of the inner surfaces 58*a* to the other of the inner surfaces 60*a* along the lateral direction A a second distance that is less than the outer dimension of the electrical cable 32. The second distance is greater than an outer dimension of the electrical conductor, such that the inner surfaces provide strain relief when the electrical cable is received in the second slot. As described above with respect to the slot 34, the slot 57 is forward facing and open in the mounting direction.

The inner surfaces of at least one of the fingers 58 and 60 can be blunt and configured to at least compress the outer electrically insulative layer 38 of the electrical cable 32, or of any suitable alternatively sized electrical cable 32, against the opposed inner surface. Further, at least one or both of the inner surfaces of at least one of the fingers 58 and 60 can define a piercing member that pierces the outer electrically insulative layer 38, but does not extend to the electrical conductor 40 when the cable is received in the second slot 57. Thus, when the insulation displacement contact 20 receives the electrical cable 32 along the mating direction, the cable 32, and a plurality of differently sized electrical cables, can be individually received in the slot 34 such that the piercing member 36 pierces through the outer electrically insulative layer 38 and contacts the electrical conductor 40. Thus, at least one or both of the inner surfaces that defines the second slot 57 is configured to be embedded in the outer electrical insulative layer 38. For instance, the piercing member of the second portion 56 can define a blade surface. Thus, the second slot 57 can be referred to as a strain relief slot, and the first slot 34 can be referred to as an insulation displacement contact slot.

The second arm 46 can define a cradle 62 that is configured to receive a length of the electrical cable 32 that extends in a downward direction along the transverse direction T from the slot 34 that is carried by the first portion 54 of the first arm 44. The cradle 62 can define a curved inner surface that is configured to correspond generally to the outer surface of the outer electrically insulative layer 38, and thus the outer surface of the electrical cable 32. The cradle 62 can be rearward facing and open in a direction opposite the mounting direction. The second arm 46 defines an inner surface 46*a* that faces the first arm 44 so as to at least partially define the gap 45. Opposed surfaces of the first and second arms 44 and 46 that define the gap 45 are spaced from each other along the transverse direction T. The cradle 62 defines an inner surface 62*a* that receives the electrical cable 32. Thus, the inner surface 46*a* is configured to abut the complementary electrical component 26 when the insulation displacement contact 20 is mounted to the complementary electrical component 26. The inner surface 62*a* of the cradle 62 is offset with respect to the inner surface 46*a* of the second arm 46 in the transverse direction T. The offset in the transverse direction is less than the outer dimension of the electrical cable 32. Accordingly, the cradle 62 is configured to compress the received electrical cable 32 against the complementary electrical component 26 so as to retain the cable 32 in the insulation displacement contact 20. Thus, the electrical cable 32 is captured between the cradle 62 and the electrical component 26.

It should be appreciated that an insulation displacement connector 64 can include a plurality of insulation displacement contacts constructed as described above with respect to the insulation displacement contact 20. The insulation displacement connector 64 can further include a connector housing, which can be electrically insulative, such that the insulation displacement contacts 20 are supported by the electrically insulative housing.

It should be further appreciated that an electrical connector assembly 66 can include the insulation displacement connector 64 or one or more of the insulation displacement contacts 20, the electrical cable 32 that extends through the slot 34, such that at least one of the inner surfaces that at least partially define the slot 34 are in physical and electrical contact with the electrical conductor 40. Electrical connector assembly 66 can further include the complementary electrical component 26 disposed in the gap 45 and in physical and electrical contact with the mounting portion 22, such that the complementary electrical component 26 is in electrical communication with the electrical conductor 40. The electrical cable 32 can extend through an aperture 27 that extends through the complementary electrical component 26, for instance along the transverse direction T, at a location between the first arm 44 and the second arm 46. The aperture 27 can extend through the electrical terminal 28 along the transverse direction T.

Thus, a method can be provided for placing the electrical cable 32 in electrical communication with the complementary electrical component 26. The method can include the step of inserting the electrical cable 32 into the slot 34 defined by the mating portion 30, the mating portion 30 defining at least one piercing member 36 that at least partially defines the slot 34, such that the piercing member 36 pierces the outer electrically insulative layer 38 of the electrical cable 32 and contacts the electrical conductor 40. The method can further include the step of placing the mounting portion 22 of the insulation displacement contact 20 in electrical communication with the complementary electrical component 26 so as to establish electrical communication between the electrical conductor and the complementary electrical component. The placing step can further include the step of inserting the complementary electrical component 26 in the gap 45 defined by the mounting portion 22 so as to place the mounting portion 22 and the complementary electrical component 26 in electrical communication with each other. The placing step can further include the step of contacting the contact pad of the complementary electrical component 26 with the mounting portion 22 so as to place the mounting portion 22 and the complementary electrical component 26 in electrical communication with each other. The inserting step can further include the step of inserting the electrical cable 32 in the second slot 57 defined by the mating portion 30, such that at least one inner surface that at least partially defines the second slot 57 pierces the outer electrically insulative layer 38 and not contact the electrical conductor 40.

The method can further include the step of inserting the cable 32 through the aperture 27 that extends through the complementary electrical component 26. Thus, a terminal portion of the cable 32 can extend through the complementary electrical component 26. The method can further include the step of placing at least a portion of the terminal end of the cable 32 into the cradle 62, such that the complementary electrical component 26 is disposed between the cradle 62 and the mating portion 30, and the cable is disposed between the cradle 62 and the complementary electrical component 26. The method can further include the step of capturing the placed cable 32 between the cradle 62 and the complementary electrical component 26. The method can further include the step of applying electrical current between the electrical cable 32 and the complementary electrical component 26. The method can further include the step of applying a data signal between the electrical cable 32 and the complementary electrical component 26. The electrical cable 32 can be a first electrical cable, and the method can further include the step of removing the first electrical cable 32 from the first and second slots and from the cradle, and repeating any one up to all of the method steps with a second electrical cable that has an outer dimension different than that of the first electrical cable.

A method can be provided for selling the insulative displacement contact 20, the insulation displacement connector 64, or the electrical connector assembly 66, the method including the steps of teaching to a third party one or more up to all of the above-described method steps, the insulative displacement contact 20, the insulative displacement connector 64, or the electrical connector assembly 66, and selling to the third party at least one or more up to all of the insulative displacement contact 20, the insulation displacement connector 64, or the electrical connector assembly 66.

Referring now to FIGS. 2A-2F, an insulative displacement contact 120 is identified with reference numerals corresponding to like elements of the insulative displacement contact 20 incremented by 100. The insulative displacement contact 120 can be constructed as described above with respect to the insulative displacement contact 20 illustrated in FIGS. 1A-1H. However, as described below, the insulative displacement contact 120 can include the first slot 134 and not the second slot 57. Further, as described below, the insulative displacement contact 120 can include a cutting surface configured to sever a terminal end 31 of the electrical cable 32. Further, as described below, the insulative displacement contact 120 can include a retention arm that is configured to attach to the cable 32 so as to provide strain relief. It should be appreciated that the insulation displacement contact 120 of FIGS. 2A-2F can alternatively or additionally include the cradle 62 described above, and can alternatively or additionally include the second portion 56 of the first arm 44 and the second slot 57 described above with respect to FIGS. 1A-1H. The insulation displacement contact 20 of FIGS. 1A-1H can alternatively or additionally include the cutting surface and the retention arm as illustrated in FIGS. 2A-2F and described in more detail below.

The insulative displacement contact 120, and all insulation displacement contacts described herein, can be made from any suitable electrically conductive material, such as a metal. The insulation displacement contact 120 includes an electrically conductive contact body 121 that, in turn, includes a mounting portion 122 that is configured to receive the edge 24 of the complementary electrical component 26, such as a printed circuit board, so as to contact the respective electrical terminal 28, such as a contact pad, of the complementary electrical component 26. The complementary electrical component 26, and all complementary electrical components described herein, can be a printed circuit board or any suitable constructed alternative electrical component 26. The electrically conductive contact body 121 further includes a mating portion 130 that is configured to attach to the electrical cable 32. The mating portion 130 can be monolithic with the mounting portion 122. The mating portion 130 can include a slot 134 that extends into the contact body 121, and at least one piercing member 136 that at least partially defines the slot 134 such that, when the slot 134 receives the electrical cable 32, the piercing member 136 pierces the outer electrically insulative layer 38 of the electrical cable 32 and contacts the electrical conductor 40 of the electrical cable 32 that is disposed inside the outer electrically insulative layer 38. It should be appreciated that the slot 134 can have a width of zero along the lateral direction A before the electrical cable 32 is inserted into the slot 134. Once the electrical cable 32 has been inserted into the slot 134, the slot 134 can define a width greater than zero. Alternatively, the slot 134 can have a width greater than zero before and after the cable 32 has been inserted into the slot 134.

The mounting portion 122 defines at least one contact surface 142 that is configured to contact the electrical terminal 28 of the complementary electrical component 26, so as to place the electrical terminal 28 in electrical communication with the mounting portion 122, and thus the mating portion 130. The mounting portion 122 defines first and second arms 144 and 146 that are spaced from each other along a transverse direction T so as to define a gap 145 therebetween, the gap 145 sized to receive the edge 24 of the complementary electrical component 26 as the mounting portion 122 moves along a mounting direction relative to the complementary electrical component 126. Opposed surfaces of the first and second arms 144 and 146 that define the gap 145 are spaced from each other along the transverse direction T. The mounting direction can be defined by a forward direction along a longitudinal direction L that is substantially perpendicular, such as angularly offset, and in one example perpendicular, with respect to the transverse direction T. Thus, the transverse direction T is substantially perpendicular to the mounting direction. As used herein, the phrase "substantially perpendicular" can refer to angularly offset, and in one example perpendicular, unless otherwise indicated.

The slot 134 extends 1) through the first arm 144 along the transverse direction T, and 2) into the first arm 146 in a direction, such as a rearward direction, opposite the forward mounting direction, along the longitudinal direction L. Both the gap 145 and the slot 134 are both forward facing and open in the mounting direction. The slot 134 has an open first end that faces a direction opposite the mounting direction, and a closed second end opposite the first end and spaced from the first end in the mounting direction. Further, the open first end of the slot 134 is spaced from the closed end of the slot 134 along a mating direction that attaches the mating portion 130 to the electrical cable 32. The mating direction can be the same as the mounting direction, and can be defined by moving the insulation displacement contact 120 toward the electrical cable 32, or by moving the electrical cable 32 toward the insulation displacement contact 120, such that relative motion of the insulation displacement contact 120 with respect to the electrical cable 32 is in the mating direction. The contact body 121 can define a joint 148 that is connected between the first and second arms, such that a mouth of the gap 145 is spaced from the joint 148 in the mounting direction. The joint 148 can thus close the rear end of the gap 145. The front end of the gap 145 is open so as to receive the edge 24 of the complementary electrical component 26 as the insulation displacement contact 120 is mounted onto the complementary electrical component 26 along the mounting direction. The joint 148 can be substantially linear, curved, or can define any shape as desired. The joint 148 can be flexible and resilient so as to allow one or both of the first and second arms 144 and 146 to resiliently flex with respect to the other of the first and second arms 144 and 146. Thus, at least one of the first and second arms 144 and 146 is flexible with respect to the other of the first and second arms 144 and 146 about the joint 148.

The first arm 144 can define include a pair of fingers 150 and 152 having respective opposed inner surfaces 150*a* and 152*a* that are spaced from each other so as to at least partially define the slot 134. For instance, the inner surfaces 150*a* and 152*a* can be spaced from each other along a lateral direction A that is substantially perpendicular to both the longitudinal direction L and the transverse direction T. The inner surface of at least one of the fingers 150 and 152 includes the piercing member 136. The mating portion 130 defines a first distance from the piercing member 136 to the opposed inner surface across the slot 134 along the lateral direction A. The first distance is less than an outer dimension, which can be a diameter, of the electrical cable 132. For instance, the first distance can be less than an outer dimension, such as an outer diameter, of the outer electrically insulative layer 38, can further be less than an inner dimension, such as an inner diameter, of the outer electrically insulative layer 38, and can further be less than an outer dimension, such as a diameter, of the electrical conductor 40. Thus, when the insulation displacement contact 120 receives the electrical cable 32 along the mating direction, the cable 32 is received in the slot 134 such that the piercing member 136 pierces through the outer electrically insulative layer 38 and contacts the electrical conductor 40. Each of the inner surfaces 150*a* and 152*a* can define a respective piercing member 136. For instance, the piercing member 136 can define a blade surface that slices through the electrically insulative layer 138 into the electrical conductor 40.

The mating portion 130 can further include a retention arm 163 that is configured to capture the cable at a location spaced rearward, e.g., along a direction opposite the mating direction, from the groove 134. The retention arm 163 includes a base 163*a* that is attached to the contact body 121, for instance at the first arm 144, and a cantilevered portion 163*b* that is cantilevered over the first arm 144, and spaced from the first arm 144 along the transverse direction T. The contact body 121 thus defines a strain relief channel 165 between the retention arm 163, for instance at the cantilevered portion 163*b*, and the first arm 144, the strain relief channel 165 defining a distance from the cantilevered portion 163*b* of the retention arm 163 to the first arm 144 that is less than the outer dimension, which can be a diameter, of the electrical cable 32. Thus, the retention arm 163 and the first arm 144 are configured to capture the outer electrically insulative layer 38 therebetween. The cantilevered portion 163*b* of the retention arm 163 can be elastically flexible away from the first arm 144.

The second arm 146 can define a cutting surface 161 that is configured to sever a length of the electrical cable 32 that extends in a downward direction along the transverse direction T from the slot 34 through an aperture 27 that extends through the complementary electrical component 26. The cutting surface 161 can be forward facing and disposed in a plane that can be defined by the lateral and the longitudinal directions. Thus, the cutting surface 161 can be angularly offset with respect to the transverse direction T. Accordingly, the electrical cable 32 can be positioned so as to extend through the aperture 27 of the complementary electrical component 26, such that a terminal portion of the electrical cable 32 extends down through the complementary electrical component 26. As the insulation displacement connector 120 is mounted onto the complementary electrical component 26, such that the edge 26 is received in the gap 145 between the first and second arms 144 and 146, a portion of the electrical cable 32 that extends up from the complementary electrical component 26 is received in the slot 134, and the cutting surface 161 is brought against the terminal portion of the electrical cable 32, and severs the electrical cable 32, including the outer insulative layer 38 and the electrical conductor 40, such that the cable 32 terminates at a location between the cutting surface 161 and the complementary electrical component 26, and thus between the cutting surface 161 and the first arm 144.

It should be appreciated that an insulation displacement connector 164 can include a plurality of insulation displacement contacts constructed as described above with respect to the insulation displacement contact 120. The insulation displacement connector 164 can further include a connector housing, which can be electrically insulative, such that the insulation displacement contacts 120 are supported by the electrically insulative housing.

It should be further appreciated that an electrical connector assembly 166 can include the insulation displacement connector 164 or one or more of the insulation displacement contacts 120, the electrical cable 32 that extends through the slot 134, such that at least one of the inner surfaces that at least partially define the slot 134 are in physical and electrical contact with the electrical conductor 40. Electrical connector assembly 166 can further include the complementary electrical component 26 disposed in the gap 145 and in physical and electrical contact with the mounting portion 122, such that the complementary electrical component 26 is in electrical communication with the electrical conductor 40. The electrical cable 32 can extends through an aperture 27 in the complementary electrical component 26 between the first arm 144 and the second arm 146, such that the terminal portion 31 of the electrical cable is aligned with the cutting surface 161 along the longitudinal direction as the insulation displacement contact 120 is being mounted onto the complementary electrical component along the mounting direction. Thus, the electrical connector assembly 166 can be configured such that the electrical cable 32 is severed at the cutting surface 161. The electrical connector assembly 166 can further be configured such that the electrical cable 32 is captured between the retention arm 163 and the first arm 144.

Thus, a method can be provided for placing the electrical cable 32 in electrical communication with the complementary electrical component 26. The method can include the step of inserting the electrical cable 32 into the slot 134 defined by the mating portion 130, the mating portion 130 defining at least one piercing member 136 that at least partially defines the slot 134, such that the piercing member 136 pierces the outer electrically insulative layer 38 of the electrical cable 32 and contacts the electrical conductor 40. The method can further include the step of placing the mounting portion 132 of the insulation displacement contact 120 in electrical communication with the complementary electrical component 26 so as to establish electrical communication between the electrical conductor 40 and the complementary electrical component 26. The placing step can further include the step of inserting the complementary electrical component 26 in the gap 145 defined by the mounting portion 132 so as to place the mounting portion 132 and the complementary electrical component 26 in electrical communication with each other. The placing step can further include the step of contacting the contact pad of the complementary electrical component 26 with the mounting portion 132 so as to place the mounting portion 132 and the complementary electrical component 26 in electrical communication with each other. The slot 134 can be defined by the first arm 144, and the method can further include the step of capturing the electrical cable 32 between the retention arm 163 and the contact body 121, such as the first arm 144.

The method can further include the step of inserting the cable 32 through the aperture 27 that extends through the complementary electrical component 26. Thus, a terminal portion of the cable 32 can extend through the complementary electrical component 26. The method can further include the step of contacting the electrical cable 32 with the cutting surface 161 of the insulation displacement contact 120 such that the cutting surface 161 severs the electrical cable 32. The method can further include the step of applying electrical current between the electrical cable 32 and the complementary electrical component 26. The method can further include the step of applying a data signal between the electrical cable 32 and the complementary electrical component 26. The electrical cable 32 can be a first electrical cable, and the method can further include the step of removing the first electrical cable 32 from the first and second slots and from the cradle, and repeating any one up to all of the method steps with a second electrical cable that has an outer dimension different than that of the first electrical cable.

A method can be provided for selling the insulative displacement contact 120, the insulation displacement connector 164, or the electrical connector assembly 166, the method including the steps of teaching to a third party one or more up to all of the above-described method steps, the insulative displacement contact 120, the insulative displacement connector 164, or the electrical connector assembly 166, and selling to the third party at least one or more up to all of the insulative displacement contact 120, the insulation displacement connector 164, or the electrical connector assembly 166.

Referring now to FIGS. 3A-3D, an insulation displacement contact 220 constructed in accordance with another embodiment includes an electrically conductive contact body 221 that, in turn, includes a mounting portion 222 that is configured to be mounted onto a complementary electrical component 26, such as a printed circuit board, so as to contact a respective electrical terminal 28, such as a contact pad, of the complementary electrical component 26. The electrically conductive contact body 221 further includes a mating portion 230 that is configured to attach to an electrical cable 32. The mating portion 230 can be monolithic with the mounting portion 222. The insulation displacement contact 220, and all insulation displacement contacts described herein, can be made from metal or any alternative suitable electrically conductive material. The mating portion 230 can include 1) a slot 234, such as an insulation displacement contact slot, that extends through the contact body 221, the contact body 221 defining at least one piercing member 236 that at least partially defines the slot 234, and 2) a retention tab 269 that is configured to receive the electrical cable 32 and bring the electrical cable 32 into contact with the at least one piercing member 236. The mating portion 230 can further define an aperture 271 that extends through the retention tab 269, the aperture sized 271 to receive the electrical cable 232. The aperture 271 can be spaced from the slot 234 along the rearward direction opposite the mating direction. The retention tab 269 is deflectable to a position whereby the electrical cable 32 that extends through the aperture 271 is brought into contact with the piercing member 236 so that the piercing member 236 pierces the outer electrically insulative layer 38 of the electrical cable 32 and contacts the electrical conductor 40 of the electrical cable 32 that is disposed inside the electrically insulative layer 38. It should be appreciated that the slot 24 can have a width of zero along the lateral direction A before the electrical cable 32 is inserted into the slot. Once the electrical cable 32 has been inserted into the slot, the slot 234 can define a width greater than zero. Alternatively, the slot 234 can have a width greater than zero before and after the cable 32 has been inserted into the slot 234.

The slot 234 can extend through the contact body 221 along a longitudinal direction L, which can define the mating direction, the slot 234 elongate in a transverse direction T that is substantially perpendicular to the longitudinal direction L. The slot 234 can define first and second outermost ends that are spaced from each other along the transverse direction T such that each of the first and second ends are open along the transverse direction T. The contact body 221 can define a pair of inner surfaces 258 and 260 that are opposite each other along a lateral direction A that is substantially perpendicular to both the longitudinal direction L and the transverse direction T. The inner surfaces 258 and 260 define the slot 234, and at least one or both of the inner surfaces 258 and 260 defines the piercing member 236, which can be configured as a blade that slices through the outer electrically insulative layer 38 and contacts the electrical conductor 40.

At least one or both of the inner surfaces 258 and 260 is tapered toward the other of the inner surfaces 258 and 260 along the lateral direction A as it extends between the respective first and second outermost ends. For instance, the at least one of the inner surfaces 258 and 260 can be tapered linearly toward the other of the inner surfaces 258 and 260. The inner surfaces 258 and 260, and thus the slot 234, define a neck 273 at a location where the inner surfaces 258 and 260 are spaced closest to each other, for instance along the lateral direction A. At least one or both of the inner surfaces 258 and 260 tapers away from the other of the inner surfaces 258 and 260, for instance linearly or in any other manner, as they extend away from both sides of the neck 273. Conversely, at least one or both of the inner surfaces 258 and 260 tapers toward the other of the inner surfaces 258 and 260, for instance linearly or in any other manner, as they extend away toward the neck from both sides of the neck 273. It should be appreciated that the contact body 221 defines a location of select distance along a straight line, for instance along the lateral direction A or a direction angularly offset with respect to the lateral direction A, from one of the inner surfaces 258 and 260 to the other of the inner surfaces 258 and 260, and the distance is less than an inner dimension of the outer electrically insulative layer 38 of the cable 32 and a plurality of electrical cables having different diameters, such that one or both of the inner surfaces is configured to contact the electrical conductor 40 when the electrical cable 32 is disposed in the slot 34. The distance, and thus the location of select distance, can be defined at the neck 273, and can further be defined at locations along the inner surfaces 258 and 260 spaced from the neck 273.

The first and second outermost ends of the slot 234 can define openings into and out of the slot 234 along the transverse direction T. The contact body 221 can defines first and second end distances along a first and second straight end lines from one of the inner surfaces 258 and 260 to the other of the inner surfaces 258 and 260 at first and second ends, respectively, that are spaced from the neck 273 such that the neck 273 is disposed between the first and second ends. Each of the first and second end distances is greater than an outer dimension of the electrically insulative layer 38. The first and second ends can, for instance, be the first and second outermost ends of the slot 234. Thus, the electrical cable 32 is sized to be inserted into the slot 34 along either the upward direction away from the mounting portion 222, or downward direction toward the mounting portion 222. Each of the first and second straight end lines extends along the lateral direction.

The aperture 273 can extend through the retention tab 269 along a central axis that is configured to be aligned with the slot 234 along the longitudinal direction L. For instance, the central axis can lie in a plane that bisects the slot 234 in the lateral direction A. The plane can be defined by the longitudinal direction L and the transverse direction T. The retention tab 269 is deflectable from a first position, whereby the central axis is aligned with one of the first and second outermost ends, to a second position, whereby the central axis is aligned with the location of select distance between the inner surfaces 258 and 260 that is less than an outer dimension of the electrical conductor 40. The central axis can move along the plane as the retention tab 269 is deflected between the first and second positions. The retention tab 269 can be hinged to a frame 219 that defines the mounting portion 222, and can be deflectable about the frame between the first and second positions. The first position can define an initial position of the retention tab 269, or the retention tab 269 can define an initial position such that the first position is between the initial position and the second position. The retention tab 269 can resiliently deflect from the initial position to a third position such that the second position is disposed between the first position and the third position. The location of select distance can be between the first position and the third position, for instance at the second position, such that when the retention tab 269 is deflected, such as depressed, to the third position, the resilience of the retention tab 269 can bias the retention tab 269 to the second position. When the retention tab 269 is in the first position and the initial position, the central axis can extend through the slot 234 at a first side of the neck 273, and when the retention tab is in the second and the third positions the central axis can extend through the slot 234 at an a second side of the neck 273 opposite the first side. As the retention tab 269 moves from the third position to the second position, the central axis moves toward the neck 273. In accordance with the illustrated embodiment, the contact body 221 defines only a single aperture 271 that is configured to receive only a single electrical cable 32, and is devoid of additional apertures that are configured to receive an electrical cable 32 and move the electrical cable into an insulation displacement contact slot, though the insulation displacement contact 220 can include as many apertures 271 and slots 234 as desired.

The contact body 221 can define the frame 219 having a pair of side walls 219*a-b*, respectively, spaced from each other along the lateral direction A, a first end wall 219*c* connected between the side walls 219*a-b*, and a second end wall 219*d* connected between the side walls 219*a-b*, such that the slot 234 extends through the second end wall 219*d*. The end walls can be spaced apart from each other along the longitudinal direction L, and the frame defines open upper and lower ends 219*e-f*, respectively, that are defined between the side walls 219*a-b* and the end walls 219*c-d*, and are spaced apart from each other along the transverse direction T. The retention tab 269 is resiliently attached to the first end wall 219*c*, and is positionable so as to extend along the open upper end 219*e* of the frame 219. For instance, the retention tab 269 includes an arm 269*a* that is attached to the first end wall 219*c* and cantilevered from the first end wall 219*c*. The arm 269*a* extends toward the second end wall 219*d*, and a flange 269*b* that extends from the arm 269*a* toward the mounting portion 222, along a direction that is angularly offset such as perpendicular from the arm 269*a*. The aperture 271 can extend through the flange 269*b*. As described above, the retention tab 269, for instance the arm 269*a*, is flexibly attached to the first end wall 219*c* such that the retention tab 269 is biased to move along a direction from the third position, and thus from the second position, toward the first position. Accordingly, the electrical cable 32 that is received in the slot 271 is biased by the retention tab 269 against the piercing member 236.

As described above, the lower end of the frame 219 defines the mounting portion 222 that is configured to be mounted onto the complementary electrical component 26. Thus, the lower end of the contact body 221 is configured to be mounted to the complementary electrical component 26. The contact body 221 can include a projection 225 that extends out from the frame 219, for instance the lower end of the frame 219, and is configured to be inserted into or through an aperture 27 of the complementary electrical component 26. The projection 225 is configured to be inserted, for instance press-fit, into the aperture 27 of the complementary electrical component 26. The aperture 27 can extend through the electrical terminal 28 of the complementary electrical component 26. The lower end of the frame 219 can be configured to be surface mounted, for instance soldered or welded, onto the complementary electrical component 26 at the electrical terminal 28. The projection 225 can further be inserted into a plated electrically conductive via of the complementary electrical component 26.

An insulation displacement connector 264 can include a plurality of insulation displacement contacts constructed as described above with respect to the insulation displacement contact 220. The insulation displacement connector 264 can further include an electrically insulative connector housing, and the insulation displacement contact or contacts 220 supported by the electrically insulative housing.

The electrical connector assembly 266 can include the insulation displacement connector 264, the electrical cable 32 that can extend through the aperture 271 and the slot 234, such that at least one or both of the inner surfaces 258 and 260 that at least partially define the slot 234 are in physical and electrical contact with the electrical conductor 40. The electrical connector assembly 266 can further include the complementary electrical component 26. The mounting portion 222 of the insulation displacement contact 220 is configured to be mounted onto the complementary electrical component 26, such that the complementary electrical component 26 is in electrical communication with the electrical conductor 40. The electrical cable 32 can terminate at a location between the slot 234 and the first end wall 219*c*. The contact body 221 can contact a contact pad of the complementary electrical component 26 so as to place the insulation displacement contact 220 in electrical communication with the complementary electrical component 26. The contact body 221 can include a projection 225 that is inserted into the aperture 27 of the complementary electrical component 26. The projection 225 can, for instance, be press-fit into the aperture 27. The projection 225 can be press-fit into a plated via of the complementary electrical component 26 so as to place the insulation displacement contact 220 in electrical communication with the complementary electrical component 26.

A method can be provided for placing the electrical cable 32 in electrical communication with the complementary electrical component 26. The method can include the step of inserting the electrical cable 32 into the aperture 271 that extends into the tab 269 of the mating portion 230 of the insulation displacement contact 220. The method can further include the step of moving the tab 269 from a first position to a second position so as to bring the electrical cable 32 into one open end of the slot 234 defined by the mating portion 230, the slot having a second open end opposite the first open end along a transverse direction, wherein each of the open ends is open along the transverse direction. The method can further include, during the moving step, the step of piercing the outer electrically insulative layer 38 of the electrical cable 32 with at least one inner surface 258 or 260 that at least partially defines the slot 234 so as to place the inner surface in physical and electrical contact with the electrical conductor 40 of the electrical cable 32. The method can further include the step of placing the mounting portion 222 of the insulation displacement contact 220 in electrical communication with the complementary electrical component 26, so as to establish electrical communication between the electrical conductor 220 and the complementary electrical component 26. The moving step can cause the piercing step.

The placing step can further include the step of contacting the contact pad of the complementary electrical component 26 with the mounting portion 222 so as to establish electrical communication between the mounting portion 222 and the complementary electrical component 26. The placing step can further include the step of inserting the projection 225 of the mounting portion 222 into the aperture 27 of the complementary electrical component 26. The placing step can further include the step of press-fitting the projection 225 into the aperture 27.

The electrical cable 32 can be referred to as a first electrical cable, and the method can further include the step of removing the first electrical cable 32 from slot and from the aperture, and repeating any one up to all of the steps of claims 40 to 44 with a second electrical cable that has an outer dimension different than that of the first electrical cable. The method can further include the step of applying electrical current between the electrical cable 32 and the complementary electrical component 26. The method can further include the step of applying a data signal between the electrical cable 32 and the complementary electrical component 26.

A method can further be provided for selling the insulative displacement contact 220, the insulation displacement connector 264, or the electrical connector assembly 266. The method can include the step of teaching to a third party one or more up to all of the method steps described above, the insulative displacement contact 220, the insulation displacement connector 264, or the electrical connector assembly 266. The method can further include the step of selling to the third party one or more of the insulative displacement contact 220, the insulation displacement connector 264, and the electrical connector assembly 266.

Referring now to FIGS. 4A-4F, an insulation displacement connector 364 constructed in accordance with another alternative embodiment can include an insulation displacement contact 320 having an electrically conductive contact body 321 that, in turn, includes a mounting portion 322 that is configured to be mounted onto a complementary electrical component 26, such as a printed circuit board, so as to contact a respective electrical terminal 28, such as a contact pad, of the complementary electrical component 26. The electrically conductive contact body 321 further includes a mating portion 330 that is configured to attach to an electrical cable 32. The mating portion 330 can be monolithic with the mounting portion 322. The insulation displacement contact 320, and all insulation displacement contacts described herein, can be made from metal or any alternative suitable electrically conductive material. The contact body 321 can further include a mating portion 330 that extends out with respect to, for instance from, the mounting portion 322.

The contact body 321 can defining a slot 334 that extends through the mating portion 330. It should be appreciated that the slot 334 can have a width of zero along the lateral direction A before the electrical cable 32 is inserted into the slot 334. Once the electrical cable 32 has been inserted into the slot, the slot 334 can define a width greater than zero. Alternatively, the slot 334 can have a width greater than zero before and after the cable 32 has been inserted into the slot 334. The mating portion 330 can thus include a pair of inner surfaces 358*a* and 360*a* spaced from each other a distance along a straight line that extends in a select direction, such as a lateral direction A, so as to at least partially define the slot 334. At least one or both of the inner surfaces 358*a* and 360*a* includes a piercing member 336. The insulation displacement connector 364 can further include a connector housing 331 that includes a housing body 333 and a cable retention channel 335 that extends through the housing body 333, wherein the connector housing 331 is configured to be placed adjacent the contact body 321 such that cable retention channel 335 defines an opening 335*a* out the housing body 333, the opening 335*a* facing the cable retention slot 334. The cable retention channel 335 is sized to receive the electrical cable 32 such that the electrical cable 32 extends out the opening 335*a*.

When the connector housing 331 is placed adjacent the contact body 321 such that the opening 335*a* faces the slot 334, the opening 335*a* defines a maximum cross-sectional dimension, such as a diameter, along the select direction, and the distance is less than the maximum cross-sectional dimension at least at a portion of the slot 334. Accordingly, the piercing member 336 is configured to pierce an outer electrically insulative layer 38 of the electrical cable 32 that extends out the opening 335*a* and contact an electrical conductor 40 of the electrical cable 32 that is disposed inside the electrically insulative layer 38. The mounting portion 322, and all mounting portions described herein, can define a mounting interface 322*a*, such that the mounting portion 322 is configured to be mounted to the complementary electrical component 26 at the mounting interface 322*a*. The mounting interface 322 can be spaced from the mating portion along at least a transverse direction T that is perpendicular to the lateral direction A. The slot 334 can extend through the mating portion 330 along the transverse direction T. The connector housing 331 is configured to be positioned between the mounting interface 322*a* and the mating portion 330, and thus between the complementary electrical component 26 and the mating portion 330, such that the opening 335*a* faces the slot 334.

The slot 334 can extend into the mating portion 330 along a longitudinal direction L that is substantially perpendicular to both the transverse direction T and the lateral direction A, so as to define a pair of fingers 358 and 360 that define pair of the inner surfaces 358*a* and 360*a*, respectively. The slot 334 can terminates in the mating portion 330 along the longitudinal direction L, such that the slot 334 defines only one outermost end that is open along the longitudinal direction L. The open outermost end is configured to receive the electrical cable 32 that is inserted into the slot 334. At least one or both of the inner surfaces 358*a* and 360*a* can be tapered, for instance linearly, toward the other along its length. The inner surfaces 358*a* and 360*a* define a neck 373 at a location where the inner surfaces 358*a* and 360*a* are spaced closest to each other, such that the inner surfaces 358*a* and 360*a* can taper away from each other, for instance linearly, as they extend away from both sides of the neck. At least one or both of the inner surfaces 358*a* and 360*a* can taper toward the other of the inner surfaces 358*a* and 360*a*, for instance from the open end toward the neck 373. Each of the inner surfaces 358*a* and 360*a* can define the piercing member 336. For instance, each of the inner surfaces 358*a* and 360*a* can defines a blade so as to define the piercing member 336. The cable retention channel 335 can extend along a central axis that extends centrally out the opening 335*a*, such that the central axis lies in a plane that bisects the slot 334 in the lateral direction A when the connector housing 331 is positioned between the mating portion 330 and the mounting interface 322*a*.

The fingers 358 and 360 can project out directly from the mounting portion 322. Alternatively, the contact body 321 can include a spacer 381 that extends between the mounting portion 322 and the mating portion 330, such that the fingers 358 and 360 extend out from the spacer 381. Each of the fingers 358 and 360 can have a length in the longitudinal direction L, a width in the lateral direction A, and a thickness in the transverse direction T, such that the width is greater than the thickness, and the length is greater than the width. The contact body 321 can further include at least one stabilizer 383 connected from the mating portion 322 to the mounting portion 330, such as a pair of stabilizers 383 that extend rearward from the fingers 358 and 360 in a direction opposite the slot 334. Each of the pair of stabilizers 383 can be spaced from each other along the lateral direction A.

The mounting portion 322 can be configured to be surface mounted, for instance soldered or welded, to the complementary electrical component 26, for instance at an electrical terminal 28. The mounting portion 322 can further include a protrusion 325 that extends out from the contact body 321 and is configured to be inserted, for instance press-fit, into an aperture 27 of the complementary electrical component 26. The aperture 27 can extend through the electrical terminal 28. The protrusion 325 can be configured to be inserted into a plated via of the complementary electrical component 26 so as to place the insulation displacement contact in electrical communication with the complementary electrical component 26.

The connector housing 331 can be electrically insulative. The opening 335*a* can be referred to as a first opening, and the contact retention channel further defines a second opening 335*b* out the housing body 333, such that the electrical cable 32 extends in the second opening 335*b* and out the first opening 335*a*. The cable retention channel 335 can be open along at least a portion of its length along the transverse direction T out the housing body 333. The open portion of the cable retention channel 335 can have a cross-sectional dimension less than that of the retained cable 32 such that the retained cable can be inserted through the cable retention channel 335 and out the first opening 335*a*, and then bent and inserted into the open portion of the channel 335 such that the cable 32 extends out the second opening 335*b* (see FIG. 4D. The first opening 335*a* can be oriented substantially perpendicular with respect to the second opening 335*b*. Thus, the connector housing 331 can be referred to as a right-angle housing. Alternatively, the connector housing 331 can be configured as a vertical housing whereby the first opening 335*a* is oriented substantially parallel with respect to the second opening 335*b*. The connector housing 331 can include a plurality of cable retention channels that extend through the housing body 333, each of the contact retention apertures configured to receive respective cables that extend out respective openings as described above. The cable retention channels can be spaced from each other, for instance along the lateral direction A. The connector housing 331 can include lands 337 that are located such that the opening 335*a* is disposed between adjacent lands 337, and the housing body 333 is recessed from the lands 337 along the transverse direction T at the openings 335. The fingers 358 and 360 are configured to ride along the lands 337 such that the inner surfaces 358*a* and 360*a* are spaced from the housing body 333 along the transverse direction T as the slot 334 receives the electrical cable 32, such that the piercing member 336 extends through the outer electrically insulative layer 38 and contacts the electrical conductor 40.

The insulation displacement connector 364 can further include a plurality of insulation displacement contacts 320 constructed as described above with respect to the insulation displacement contact 320. Each of the insulation displacement contacts 320 can be spaced from each other, for instance along the lateral direction, and are configured to be mounted to the complementary electrical component 26 and mated to the electrical cables that extend out the openings of the cable retention channels in the manner described above.

An electrical connector assembly 366 can include the insulation displacement connector 364, the electrical cable 32 that is configured to extend through the cable retention channel 333, out the opening 335 and into slot 334, such that at least one of the inner surfaces 358*a* and 360*a* is in physical and electrical contact with the electrical conductor 40. The electrical connector assembly 366 can further include the complementary electrical component 26. The mounting portion 322 of the insulation displacement contact 320 is configured to be mounted onto the complementary electrical component 26, such that the complementary electrical component 26 is in electrical communication with the electrical conductor 40. The contact body 321 can contact a contact pad of the complementary electrical component 26 so as to place the insulation displacement contact 320 in electrical communication with the complementary electrical component 26.

A method can be provided for placing the electrical cable 32 in electrical communication with the complementary electrical component 26. The method can include the steps of inserting the electrical cable 32 into the cable retention channel 335 that extends through a housing body 333 of a connector housing 331, such that a portion of the cable 32 extends out the connector housing 331. The method can further include the step of moving the connector housing 331 along an insertion direction ID to a position adjacent the insulation displacement contact 320, for instance between the mating portion 330 and the mounting interface 322*a*, such that the central axis of the cable retention channel 335 is aligned with the slot 334. The method can thus further include the step of inserting the portion of the cable 332 that extends out the opening 335*a* into the slot 334 that extends through the mating portion 330, such that at least one or both of the inner surfaces 358*a* and 360*a* that at least partially defines the slot 334 pierces the outer electrically insulative layer 38 of the portion of the electrical cable 32 and contacts the electrical conductor 40 of the portion of the electrical cable 32. The method can further include the step of placing the mounting portion 322 of the insulation displacement contact 320 in electrical communication with the complementary electrical component 26 so as to place the complementary electrical component 26 in electrical communication with the electrical cable 32.

The moving step and the inserting steps can be performed after to the placing step. Alternatively, the moving step and the inserting steps can be performed prior to the placing step. The moving step can further include moving the connector housing to a position between the mating portion 330 and the complementary electrical component 26 to which the insulation displacement connector 320 is mounted. The second inserting step can cause the opposed inner surfaces 358*a* and 360*a* that at least partially define the slot 334 to pierce the outer electrically insulative layer 38 and contact the electrical conductor 40. The moving step can cause the second inserting step.

The placing step can further include the step of contacting a contact pad of the complementary electrical component 26 with the mounting portion 322 so as to establish electrical communication between the mounting portion 322 and the complementary electrical component 26. The placing step can further include the step of inserting the projection 325 into the aperture 27 of the complementary electrical component 26. The placing step can further include the step of press-fitting the projection 325 into the aperture 27, which can be the plated via. The method can include the step of applying electrical current between the electrical cable 32 and the complementary electrical component 26. The method can include the step of applying a data signal between the electrical cable and the complementary electrical component.

The first inserting step can further include the step of inserting a plurality of electrical cables 32 into respective cable retention channels 335 that extend through the housing body 333, such that a portion of each of the electrical cables 32 extends out the connector housing 331, and the second inserting step can further include inserting the portion of each of the cables 32 into a respective slot 334 that extends through a mating portion 330 of a respective insulation displacement contact 320, such that at least one or both of the an inner surfaces 358*a* and 360*a* of the mating portion 330 that at least partially defines the respective slot 334 pierces the outer electrically insulative layer 38 and contacts the electrical conductor 40.

A method can be provided for selling the insulation displacement connector 364, or the electrical connector assembly 366. The method can include the steps of teaching to a third party one or more up to all of the method steps described above, the insulation displacement connector 364, and the electrical connector assembly 366. The method can further include the step of selling to the third party at least one or more of the insulation displacement connector 364 and the electrical connector assembly 366.

Referring now to FIGS. 5A-5K, an insulation displacement connector 464 can include a connector housing 431, which can be electrically insulative, and at least one insulation displacement contact 420 such as a plurality of insulation displacement contacts 420 each having an electrically conductive contact body 421 that, in turn, includes a mounting portion 422 that defines first and second ends, and is configured to be mounted onto a complementary electrical component 26, such as a printed circuit board, so as to contact a respective electrical terminal 28, such as a contact pad, of the complementary electrical component 26. The first and second ends can be spaced from each other along the longitudinal direction L. The electrically conductive contact body 421 further includes a mating portion 430 that extends out relative to the first end of the mounting portion 422, and is configured to attach to an electrical cable 32. The mating portion 430 can be monolithic with the mounting portion 422. The insulation displacement contact 420, and all insulation displacement contacts described herein, can be made from metal or any alternative suitable electrically conductive material. The contact body 421 further includes a mating portion that extends out with respect to, for instance from, the mounting portion 422.

The contact body 421 includes an insulation displacement contact slot 434 that extends through the mating portion 430, and a strain relief slot 457 that extends through the mating portion 430. The strain relief slot 457 is aligned with the insulation displacement contact slot 434 along a longitudinal direction L so that the insulation displacement contact slot 434 is disposed between the strain relief slot 457 and a midpoint of the mounting portion 422 along the longitudinal direction L. When an electrical cable 32 extends through the both slots 457 and 434 along the longitudinal direction L, 1) a piercing member 436 that at least partially defines the insulation displacement contact slot 434 pierces an outer electrically insulative layer 38 of the electrical cable 32 and contacts an electrical conductor 40 of the electrical cable 32 that is disposed inside the electrically insulative layer 38, and 2) opposed inner surfaces 491*a* and 493*a* that at least partially define the strain relief slot 457 grip the outer electrically insulative layer 38 without extending through the outer electrically insulative layer to the electrical conductor 40. The inner surfaces 491*a* and 493*a* can be spaced from each other along a lateral direction A that is perpendicular to the longitudinal direction L.

The mating portion 430 defines a first pair of opposed inner surfaces 458*a* and 460*a* that can be spaced along the lateral direction A and can at least partially define the insulation displacement contact slot 434 and define a first cross-sectional dimension therebetween, such that at least one or both of the inner surfaces 458*a* and 460*a* present a piercing member 436 that pierces an outer electrically insulative layer 38 of the electrical cable 32 disposed in the insulation displacement contact slot 434 so as to extend through the electrically insulative layer 38 and contact the electrical conductor 40. For instance, at least one or both of the inner surfaces 458*a* and 460*a* can define a blade so as to define the piercing member 436. The opposed inner surfaces 491*a* and 493*a* that at least partially define the strain relief slot 457 define a second cross-sectional dimension at a location aligned with the first cross-sectional dimension along the longitudinal direction L, the second cross-sectional dimension greater than the first cross-sectional dimension and less than the outer cross-sectional dimension, such as the diameter, of the outer electrically insulative portion 38. Accordingly, at least one or both of the inner surfaces 491*a* and 493*a* can abut so as to compress, or pierce, the outer electrically insulative layer but does not contact the electrical conductor.

The mating portion 422 can include a first arm 444 that extends out with respect to, for instance from, the mounting portion 430. The first arm 444 includes a first portion 444*a* that defines the insulation displacement contact slot 434, and a second portion 444*b* that defines the strain relief slot 457. The first arm 444 defines a bent region 455 between the slots 434 and 457. The first portion 444*a* extends outward along a direction away from the mounting portion 430 and toward the bent region 455 along at least a transverse direction T, and the second portion 444*b* extends inward from the bent region 455 toward the mounting portion 430 along at least the transverse direction T. The transverse direction T is perpendicular to the longitudinal direction L and the lateral direction A. The insulation displacement contact slot 434 can be continuous with the strain relief slot 457. At least one or both of the slots 434 and 457 defines an open end and a closed end that is opposite the open end, for instance spaced therefrom along the transverse direction, such that the slots 434 and 457 are configured to receive the electrical cable 32 along an insertion direction from the open end toward the closed end.

The mating portion 430 can define a second arm 446 that extends out with respect to, for instance from, the second end of the mounting portion 422, such that the mounting portion 422 extends between the first and second arms 444 and 446 along the longitudinal direction L. The second arm can define a cutting surface 461 that is aligned with both the insulation displacement contact slot 434 and the strain relief slot 457 along the longitudinal direction L. The cutting surface 461 can be configured to sever a portion of the electrical cable that extends through the strain relief slot 457 and the insulation displacement contact slot 434. The insulation displacement contact slot 434 can be disposed between the strain relief slot 457 and the cutting surface 461, for instance along the longitudinal direction L. The cutting surface 461 can be curved along the longitudinal direction away from the insulation displacement contact slot 434 as it extends down along the transverse direction T toward the mounting portion 422. The cutting surface 416 is aligned along the longitudinal direction L with a location between the open end and the piercing member 436 of the insulation displacement contact slot 434.

The insulation displacement contact slot 434 can be referred to as a first insulation displacement contact slot, and the mating portion 430 further defines a second insulation displacement contact slot 435 that extends through the second arm 446. The second arm 446 can include a piercing member 436 that at least partially defines the second insulation displacement contact slot 435. The piercing member of the second insulation displacement contact slot 435 is configured to pierce the outer electrically insulative layer 38 and contact the electrical conductor 40 when the electrical cable 32 is disposed in the second insulation displacement contact slot 435. It should be appreciated that the second insulation displacement contact slot 435 can have a width of zero along the lateral direction A before the electrical cable 32 is inserted into the second insulation displacement contact slot 435. Once the electrical cable 32 has been inserted into the second insulation displacement contact slot 435, the second insulation displacement contact slot 435 can define a width greater than zero. Alternatively, the second insulation displacement contact slot 435 can have a width greater than zero before and after the cable 32 has been inserted into the second insulation displacement contact slot 435. The second insulation displacement contact slot 435 is disposed between the first insulation displacement contact slot 434 and the cutting surface 461 along the longitudinal direction L. The second arm 446 can include a first portion 446*a* that defines the second insulation displacement contact slot 435, and a second portion 446*b* that defines the cutting surface 461. The second arm 446 defines a bent region 447 between the second insulation displacement contact slot 435 and the cutting surface 461. The first portion 446*a* extends outward along a direction up along the transverse direction away from the mounting portion 422 and toward the bent region 447, and the second portion 446*b* can extends inward from the bent region 447 down along the transverse direction T toward the mounting portion 442. The second arm 446 defines a pair of inner surfaces 458*b* and 460*b* that are spaced from each other, for instance along the lateral direction A, and at least partially define the second insulation displacement contact slot 435. At least one or both of the inner surfaces 458*b* and 460*b* can define a piercing member 436, which can be configured as a blade.

The inner surfaces 458*a* and 460*a* can be spaced from each other, for instance along the lateral direction A, so as to define a cross-sectional dimension that is less than inner the cross-sectional dimension, such as diameter, of the insulation layer 38, such that the inner surfaces 458*a* and 460*a* are configured to contact the electrical conductor 40. Similarly, the inner surfaces 458*b* and 460*b* can be spaced from each other, for instance along the lateral direction A, so as to define a cross-sectional dimension, which can be equal to that of the inner surfaces 458*a* and 460*a*, that is less than inner the cross-sectional dimension, such as diameter, of the insulation layer 38, such that the inner surfaces 458*b* and 460*b* are configured to contact the electrical conductor 40.

The second portion 446*a* of the second arm 446 defines a cutting slot 449 having an open end, the cutting slot 449 defined by opposed inner surfaces, spaced along the lateral direction A, of the second portion 446*a* of the second arm 446, and the cutting slot 461 has a closed base defined by the cutting surface 461. The cutting slot 449 can be continuous with the second insulation displacement contact slot 435. All of the first and second insulation displacement contact slots 434 and 435, the strain relief slot 457, and the cutting slot 461 define a closed base and an open end that is spaced from the closed base such that the closed base is disposed between the open end and the mounting portion 422, and are configured to receive the same electrical cable 32 along a direction, such as the transverse direction, from the respective open ends toward the bases.

The mounting portion 422 is configured to be surface mounted to the electrical terminal 27 of the complementary electrical component 26. The mounting portion can alternatively or additionally include a protrusion configured to be inserted, for instance press-fit, into an aperture of the complementary electrical component 26 in the manner described above. For instance, the protrusion is configured to be inserted into a plated via of the complementary electrical component 26.

The insulation displacement connector 464 can include one or more such as a plurality of the insulation displacement contacts 420, and the connector housing 431. The connector housing 531 can include a housing body 433 and at least one such as a plurality of cable retention channels 435 that extend through the housing body 434. Each cable retention channel 435 is configured to receive a respective electrical cable 32, and further configured to be moved with respect to the insulation displacement contact 420 down along the transverse direction, in the insertion direction, toward the mounting portion 422, and thus toward the complementary electrical component 26, so as to insert the retained electrical cable 32 into the first and second insulation displacement contact slots 434 and 435, the strain relief slot 457, and the cutting slot 449. The connector housing 431 can define at least one pair of apertures 441*a-b* such as a plurality of pairs of apertures 441*a-b*. The apertures 441*a-b* can extend at least into the housing body at a location that faces the mounting portion 422, and thus the complementary electrical component 26. The apertures 441*a* and 441*b* are sized to receive respective ones of the first and second arms 444 and 446 as the connector housing 431 is moved along the insertion direction over the insulation displacement contact 420.

The cable retention channel 435 can be substantially closed about its perimeter. Alternatively, at least a portion of the perimeter of the cable retention channel is open at one end, for instance at the surface of the connector housing 431 that faces the mounting portion 422 and the complementary electrical component 26. Thus, the open end of the cable retention channel 435 can be a lower end that faces the mounting portion 422 when the retained cable 32 is inserted into the slots 433, 435, 457, and 449 of the mating portion 430. The housing body 433 can define a first rib 443*a* that defines one end of the first aperture 441*a*, a second rib 443*b* that is disposed between the first and second apertures 441*a* and 441*b*, and can define a second end of the first aperture 441*a* and a first and of the second aperture 441*b*, and a third rib 443*c* that can define a second end of the second aperture 441*b*. The ends of the apertures 441*a* and 441*b* can be spaced from each other and aligned along the longitudinal direction L. The perimeter of the cable retention channel 435 can be open at the first and second ribs 443*a* and 443*b*, and substantially closed at the third rib 443*c*. The second rib 443*b* is configured to be disposed between the first and second arms 444 and 446 along the longitudinal direction L when the first and second apertures 441*a* and 441*b* receive the first and second arms 444 and 446, respectively. The housing body 433 can include at least one projection 445, such as a pair of projections 445, that extends out from at least one of the ribs, such as the first rib 443*a*, so as to pierce the outer electrically insulative layer 38 and provide additional strain relief to the electrical cable 32. The connector housing 431 is configured to rest against the complementary electrical component 26 when the retained cable 32 is fully seated in the slots of the mating portion 430.

An electrical connector assembly 466 can include the insulation displacement connector 464, the electrical cable 32, and the complementary electrical component 26. A method of placing the electrical cable 32 in electrical communication with the complementary electrical component 26 can include the steps of placing the mounting portion 422 in electrical communication with the complementary electrical component 26, and inserting the electrical cable 32 into both the insulation displacement contact slot 434 and the strain relief slot 457. The insulation displacement contact slot 434 is disposed between the strain relief slot 457 and a midpoint of the mounting portion 422, such that an inner surface of the mating portion 430 that at least partially defines the insulation displacement contact slot 434 pierces the outer electrically insulative layer 38 and contacts the electrical conductor 40.

The placing step can be performed prior to or after performing the inserting step. The inserting step can further include the step of bringing the electrical cable 32 against the cutting surface 461 so as to sever the electrical cable 32 at a location, whereby that the insulation displacement contact slot 434 is disposed between the location and the strain relief slot 457 along the longitudinal direction L. The curvature of the cutting surface 461 causes the cutting surface 461 to eject the severed portion of the cable along the longitudinal direction L away from the insulation displacement contact slot 434. The inserting step further comprises the step of inserting the electrical cable 32 into the second insulation displacement contact slot 435, such that the piercing member 436 that at least partially defines the second insulation displacement contact slot 435 pierces the outer electrically insulative layer 38 and contacts the electrical conductor 40. The method can further include the steps of feeding the electrical cable 32 into the cable retention channel 435 that extends through the housing body 433 of the connector housing 451, and moving the connector housing 431 in the insertion direction to a position adjacent the insulation displacement contact 420, such that the moving step causes the inserting step.

The method can further include the step of, after the severing step, moving the connector housing 431 in a direction opposite the insertion direction, such that the cable 32 is removed from the connector housing 431 out an open portion of a perimeter of the cable retention channel 435 as the connector housing 431 is removed from the insulation displacement contacts 420 and the complementary electrical component 26 along a removal direction opposite the insertion direction. The cables 32 can remain in the slots of the mating portion 422 as the connector housing 431 is removed. The method can include the step of applying electrical current between the electrical cable 32 and the complementary electrical component 26. The method can include the step of applying a data signal between the electrical cable 32 and the complementary electrical component 26.

A method can be provided for selling one or more up to all of the insulation displacement connector 464, the insulation displacement contact 420, or the electrical connector assembly 466. The method can include the steps of teaching to a third party one or more up to all of the method steps disclosed above, the insulation displacement connector 464, or the insulation displacement contact 420. The method can further include the step of selling to the third party at least one or more of the insulation displacement connector 464, the electrical connector assembly 466, or the insulation displacement contact 420.

Referring now to FIGS. 6A-L, an insulation displacement connector 564 constructed in accordance with another embodiment includes a connector housing 531 and at least one such as a plurality of insulation displacement contacts 520 each having an electrically conductive contact body 521 that, in turn, includes a mounting portion 522 that is configured to be mounted onto a complementary electrical component 26, such as a printed circuit board, so as to contact a respective electrical terminal 28, such as a contact pad, of the complementary electrical component 26. The mounting portion 522 defines first and second opposed ends spaced from each other along a longitudinal direction L. The electrically conductive contact body 521 further includes a mating portion 530 that is configured to attach to an electrical cable 32. The mating portion 530 can be monolithic with the mounting portion 522. The insulation displacement contact 520, and all insulation displacement contacts described herein, can be made from metal or any alternative suitable electrically conductive material.

The contact body 521 further includes a mating portion 530 that extends out with respect to, for instance from, the mounting portion 522. The contact body 521 can include 1) a first arm 544 that extends out with respect to, for instance from, the first end of the mounting portion 522 and toward the second end of the mounting portion 522, and 2) a second arm 546 that extends out with respect to, for instance from, the second end of the mounting portion 522 and extends toward the first end of the mounting portion 522. The first and second arms 544 and 546 can be spaced from each other, for instance along a lateral direction A that is substantially perpendicular to the longitudinal direction L, so as to define first and second insulation displacement contact slots 534 and 535 that are spaced from each other and aligned with each other along the longitudinal direction L. At least one or both of the first and second arms 544 and 546 includes at least one piercing member 536 that at least partially defines at least one or both of the slots 534 and 535, and pierces an outer electrically insulative layer 38 of the electrical cable 32 and contacts an electrical conductor 40 of the electrical cable 32 that is disposed inside the electrically insulative layer 38 when the electrical cable 32 is disposed in the respective at least one or both of the slots 534 and 535. It should be appreciated that the slot 534 can have a width of zero along the lateral direction A before the electrical cable 32 is inserted into the slot 534. Once the electrical cable 32 has been inserted into the slot 534, the slot 534 can define a width greater than zero. Alternatively, the slot 534 can have a width greater than zero before and after the cable 32 has been inserted into the slot 534. Similarly, the slot 535 can have a width of zero along the lateral direction A before the electrical cable 32 is inserted into the slot 535. Once the electrical cable 32 has been inserted into the slot 535, the slot 535 can define a width greater than zero. Alternatively, the slot 535 can have a width greater than zero before and after the cable 32 has been inserted into the slot 535.

Each of the first and second arms 544 and 546 defines a respective proximal portion **544*a* and 546*a* that is attached to the mounting portion 522. For instance, the proximal portion 544*a* is attached to the first end of the mounting portion 522, and the second proximal end 546*a* is attached to the second end of the mounting portion 522. The mounting portion can be configured as a plate that can be substantially planar along the longitudinal direction and the lateral direction A, or alternatively shaped as desired. Each of the first and second arms 544 and 546 can further define a respective distal portion 544***b* and 546*b* opposite the corresponding proximal portion 544*a* and 544*b*. The distal portions 544*b* and 546*b* are free from attachment to the mounting portion 522. Thus, the first and second arms 544 and 546 are cantilevered from the respective proximal ends 544*a* and 546*a* over the mounting portion 522 along the transverse direction T, which is substantially perpendicular to both the lateral direction A and the longitudinal direction L.

The proximal portion 544*a* of the first arm 544 defines a first inner surface 558*a*, and the distal portion 546*b* of the second arm 546 defines a second inner surface 560*a* that is opposite the first inner surface 558*a*, for instance along the lateral direction A, so as to define the first slot 534. At least one or both of the first and second inner surfaces 558*a* and 560*a* defines the piercing member 536. The distal portion 544*b* of the first arm 544 defines a third inner surface 558*b*, and the proximal portion 546*a* of the second arm 546 defines a fourth inner surface 560*b* that is opposite the third inner surface 558*b*, for instance along the lateral direction A, so as to define the second slot 535. At least one or both of the third and fourth defines the piercing member 536. Each of the first and second slots 534 and 535 defines an open end that faces up along the transverse direction T away from the mounting portion 522, and the complementary electrical component 26 to which the mounting portion 522 is mounted, so as to define an insertion direction into the slots in a downward direction along the transverse direction T, and thus toward the mounting interface 522 and the complementary electrical component 26. Thus, each of the first and second slots 534 and 535 has an open first end, and can have a closed second end that is spaced from the open first end in the insertion direction.

At least a portion of at least one or both of the first and second arms 544 and 546 is tapered inwardly tapers inwardly along a direction from the respective proximal portion 544*a* and 546*a* toward the respective distal portion 544*b* and 546*b*, respectively. For instance, each of the first and second arms 544 and 546 defines opposed sides 544*c* and 546*c*, respectively, that are spaced from each other along the lateral direction A. The sides 544*c* converge toward each other, and the sides 546*c* converge toward each other, as at least a portion of the respective first and second arms 544 and 546 extend along a direction from the respective proximal portion 544*a* and 546*a* toward the respective distal portion 544*b* and 546*b*. For instance, each of the first and second arms 544 and 546 includes a respective bridge 544*d* and 546*d* that extends between the respective proximal portion 544*a* and 546*a* and the respective distal portion 544*b* and 546*b*. The bridges 544*d* and 546*d* can be spaced above the mounting portion 522 along the transverse direction. The bridges 544*d* and 546*d* can be tapered inwardly along a direction from the respective proximal portion 544*a* and 546*a* toward the respective distal portion 544*b* and 546*b*. For instance, the bridges 544*d* and 546*d* can be tapered inwardly from the respective proximal portion 544*a* and 546*a* to the respective distal portion 544*b* and 546*b*. In accordance with the illustrated embodiment, the respective opposed sides 544*c* and 546*c* converge toward each other as the respective bridges 544*d* and 546*d* taper inwardly. Each of the first and second arms 544 and 546 are elongate along respective central axes that are substantially parallel to each other as they extend along the proximal portions 544*a* and 546*a*, along the respective bridges 544*d* and 546*d*, and along the distal portions 544*b* and 546*b*.

The proximal portions 544*a* and 546*a* extend out from the mounting portion 522 to the respective bridge 544*d* and 546*d*, and the distal portions 544*b* and 546*b* extend in from the respective bridge 544*d* and 546*d* toward the mounting portion 522. The distal portions 544*b* and 546*d* can each include a respective finger 547*a* and 547*b* that extends from the respective bridge 544*d* and 546*d* toward the mounting portion 544. The fingers 547*a* and 547*b* can terminate at a location spaced from the mounting portion 522 so as to define a respective distal end 549*a* and 549*b*. For instance, the fingers 547*a* and 547*b* can extend substantially linearly from the respective bridges 544*d* and 546*d* to the respective distal ends 549*a* and 549*b* that face the mounting portion 522. Alternatively, the distal ends 549*a* and 549*b* can extend out from the respective fingers 547*a* and 547*b* along a direction that is angularly offset from the finger. For instance, the distal ends 549*a* and 549*b* can extend substantially along the mounting portion 522.

As described above, the proximal end 544*a* of the first arm 544 and the distal portion 546*b* of the second arm 546 define the first slot 534, and the distal portion 544*b* of the first arm 544 and the proximal portion 546*a* of the second arm 546 define the second slot 535. The distal portions 544*b* and 546*b* that at least partially define the first and second slots 534 and 535, respectively, are configured to deflect away from the corresponding proximal portion 546*a* and 544*a* at the respective first and second slots 534 and 535 when the electrical cable 32 is inserted into the first and second slots 534 and 535 along the insertion direction. For instance, the electrical cable 32 defines an outer cross-sectional dimension in the lateral direction A when inserted in the slots 534 and 535 that is greater than a distance between the portions of the arms 544 and 546 that define the respective slots. Accordingly, the electrical cable 32 biases the distal portions to deflect away from the proximal portions. The outer cross-sectional dimension of the electrical cable can be a diameter.

Thus, the third inner surface 558*b* displaces angularly, for instance rotates, with respect to the first inner surface 558*a* in a first angular direction when the electrical cable 32 is inserted into the first slot 534. Similarly, the second inner surface 560*a* displaces angularly, for instance rotates, with respect to the fourth inner surface 560*b* in a second angular direction when the electrical cable 32 is inserted into the second slot. The first angular direction is opposite the second angular direction. After angular displacement of the second and third inner surfaces 560*a* and 558*b*, a midline of the first slot 534 that is equidistant to the inner surfaces that define the first slot 534 is offset, for instance angularly offset and offset along the lateral direction A, from a midline of the second slot that is equidistant to the inner surfaces that define the second slot 535.

At least one or more up to all of the inner surfaces 558*a-b* and 560*a-b* can define a respective shoulder 555 that projects toward the opposed inner surface of the respective slot. A distance between the shoulder and the opposed inner surface along the lateral direction is less than the outer cross-sectional dimension of the electrical cable 32, which can be defined by the outer cross-sectional dimension, for instance diameter, of the outer electrically insulative layer 38. Thus, the shoulders 555 are configured to remove a portion of the outer electrically insulative layer 38 from the electrical conductor 40 as the electrical cable 32 is inserted into the respective slots 534 and 535 along the insertion direction. The respective inner surfaces that define the shoulders 555 can be tapered inwardly in the longitudinal direction L as they extend along the insertion direction from the shoulder 555. One or more up to all of the shoulders 555 can be substantially L-shaped from a view to the respective inner surface along the longitudinal direction L (see FIG. 6D). Alternatively or additionally, one or more up to all of the shoulders 555 can be substantially V-shaped (see FIG. 6G), including substantially U-shaped, W-shaped, M-shaped, or alternatively shaped as desired so as to define at least one angled or rounded vertex, from a view to the respective inner surface along the longitudinal direction L. The first and second slots 534 and 535 can be substantially U-shaped, including V-shaped. Thus, at least one or both of the first and second slots 534 and 535 can define at least one angled or rounded vertex at its closed end, from a view to the slots 534 and 535 along the longitudinal direction L.

The mounting portion 522 is configured to be surface mounted, for instance soldered, welded, or the like, onto the complementary electrical component 26, for instance to the electrical terminal 28. Alternatively or additionally, the mounting portion 522 can include a projection that is configured to be inserted into an aperture of the complementary electrical component 26. The projection can be press-fit into the aperture of the complementary electrical component 26, which can be an electrically conductive plated via.

The insulation displacement connector 564 can include at least one such as a plurality of the insulation displacement contact 520 and the connector housing 531. The connector housing 531 includes that includes a housing body 533 and at least one such as a plurality of cable retention channels 535 that extends at least into or through the housing body 535 along the longitudinal direction L. The cable retention channels 535 are configured to receive and retain the electrical cable 532. The housing body 533 is configured to move relative to the insulation displacement contact or contacts 520 along the insertion direction such that the retained electrical cable or cables 32 are inserted into the first and second slots 534 and 535 of the respective insulation displacement contact or contacts 520. The housing 531 can include at least one opening 581 that is configured to receive a respective one of the insulation displacement contacts 520 as the housing 531 is moved in the insertion direction so as to insert the retained electrical cables 32 into the respective first and second slots 534 and 535 so as to attach the insulation displacement contacts 520 to the electrical cable 32, and in particular to the electrical conductor 32. At least a portion of the cable retention channels 535 at the respective perimeters can be open, for instance out the connector housing 531 at a location that faces the mounting portion 522 and is configured to abut the complementary electrical component 26. Thus, the connector housing 531 in a direction opposite the insertion direction, such that the cable 32 is removed from the connector housing 531 out the open portion of a perimeter of the cable retention channel 535 as the connector housing 531 is removed from the insulation displacement contacts 520 and the complementary electrical component 26 along a removal direction opposite the insertion direction. The cables 32 can remain in the slots 534 and 535 of the mating portion 522 as the connector housing 531 is removed.

An electrical connector assembly 566 includes one or more of the insulation displacement contacts 520 or the or the insulation displacement connector 564, at least one such as a plurality of the electrical cables 32, and the complementary electrical component 26. The mounting portion 522 is configured to be mounted onto the complementary electrical component 522, such that the complementary electrical component 522 is in electrical communication with the electrical conductor 40 when the electrical cables 32 are attached to the insulation displacement contacts 520. The assembly 566 can further include the connector housing, wherein the electrical cables 32 extend at least into the cable retention channel 535.

Figure 6A:
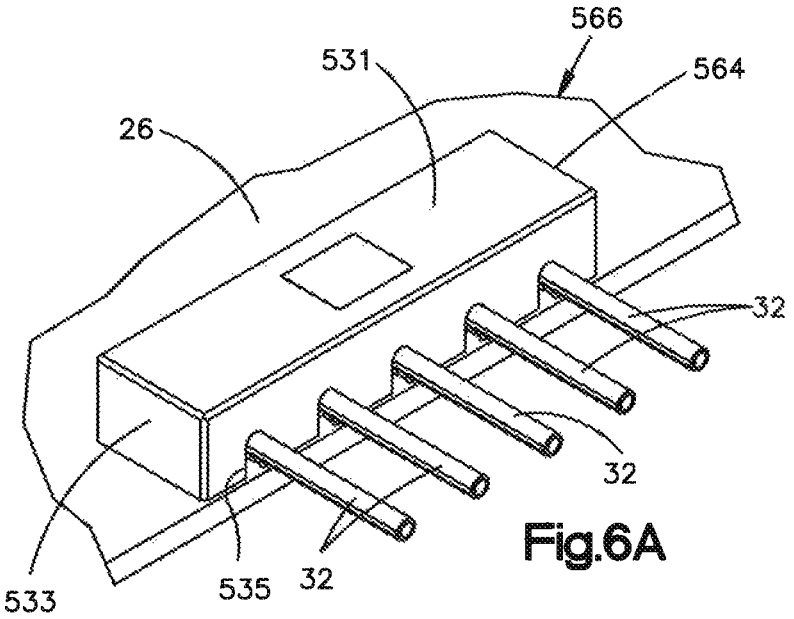
FIG. 6A is a perspective view of an electrical connector assembly constructed in accordance with another embodiment, including a printed circuit board, a plurality of cables, a plurality of insulation displacement contacts configured to be mounted to the printed circuit board and mated to the cables, and a connector housing configured to retain the cables.
Figure 6B:
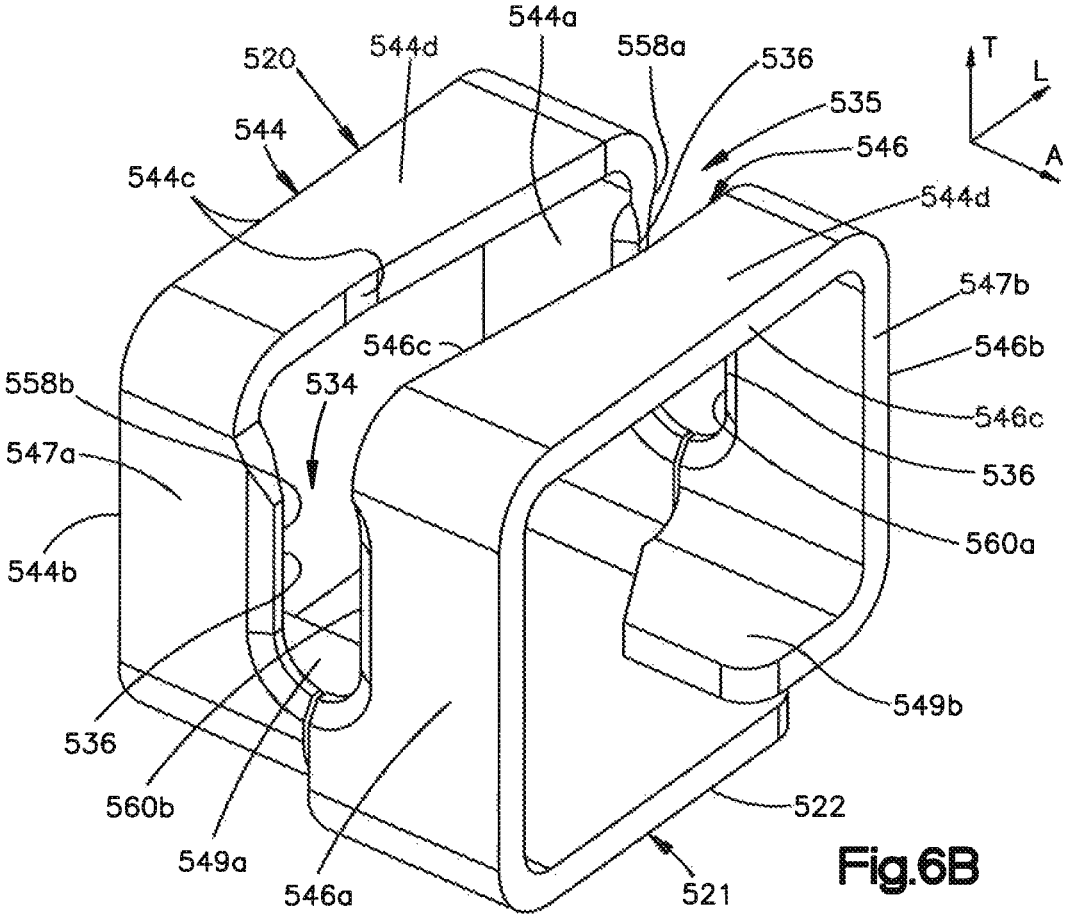
FIG. 6B is a perspective view of one of the insulation displacement contacts illustrated in FIG. 6A.
Figure 6D:
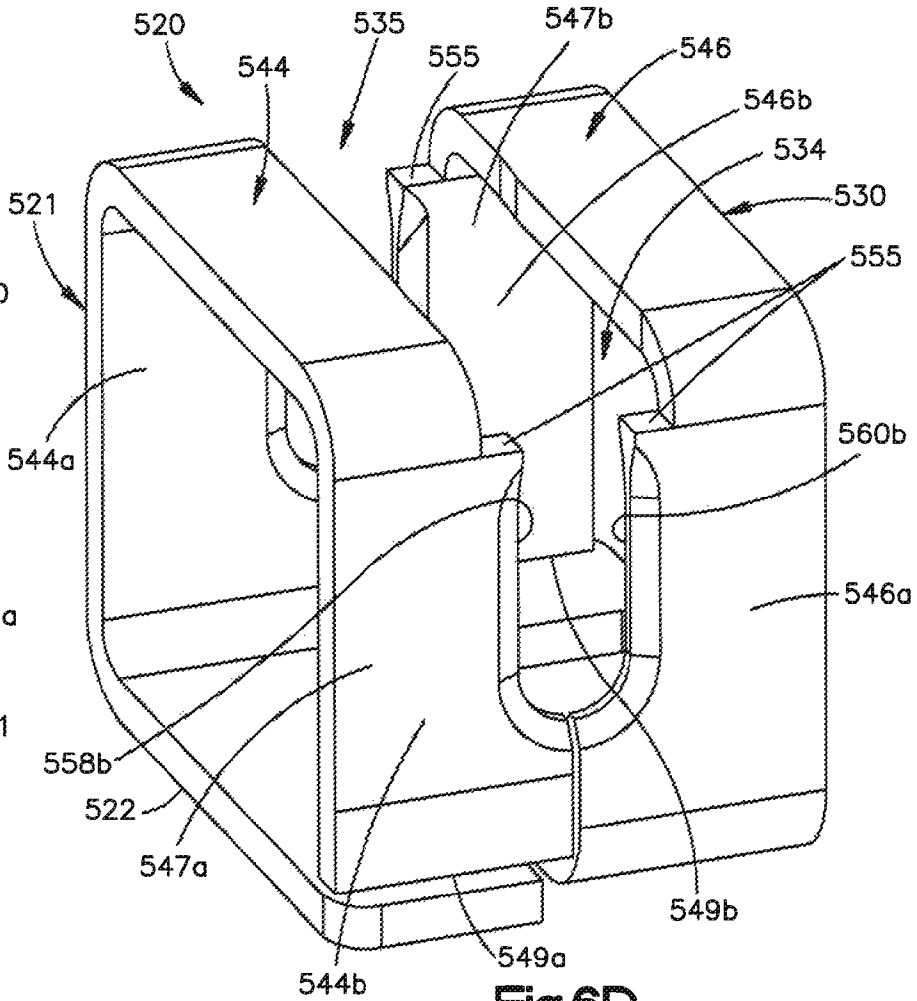
FIG. 6D is another perspective view of the insulation displacement contact illustrated in FIG. 6A.
Figure 6C:
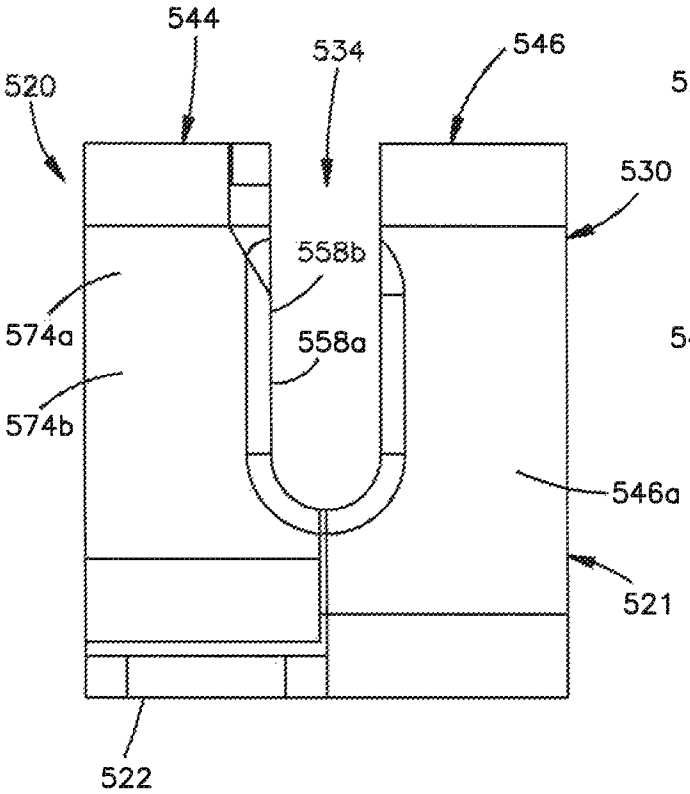
FIG. 6C is an end elevation view of the insulation displacement contact illustrated in FIG. 6A.
Figure 6E:
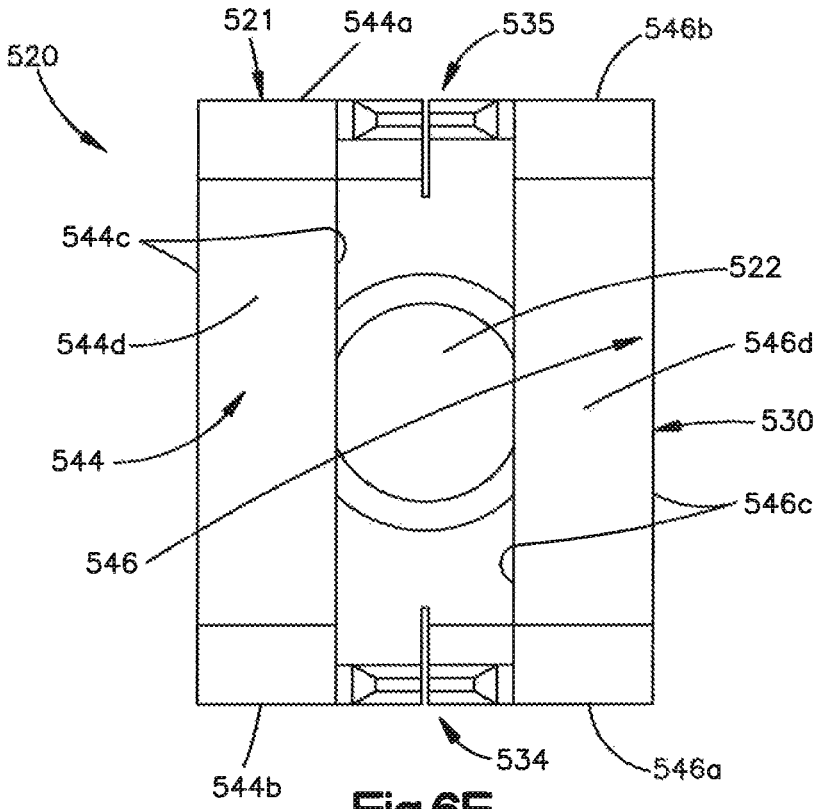
FIG. 6E is a top plan view of the insulation displacement contact illustrated in FIG. 6A.
Figure 6F:
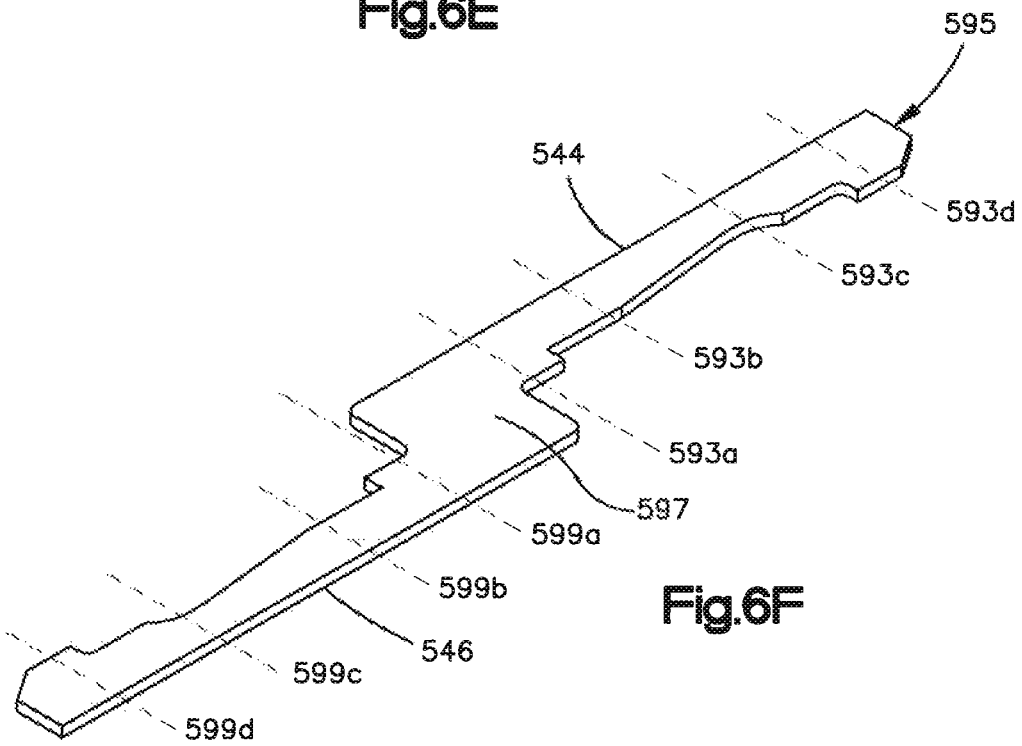
FIG. 6F is a perspective view of a blank of sheet metal that can be bent to construct the insulation displacement contact illustrated in FIGS. 6B-E.
Figure 6G:
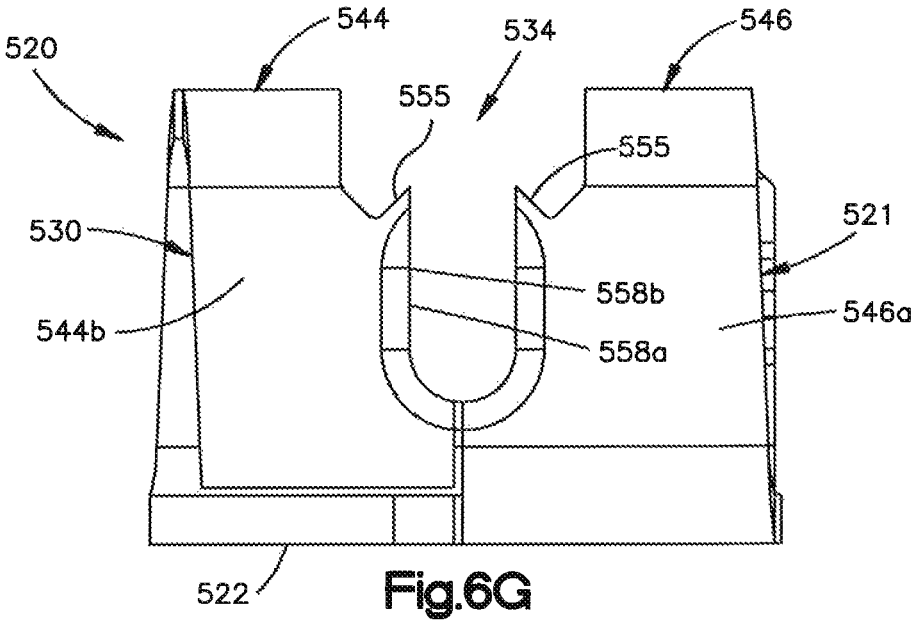
FIG. 6G is an end elevation view of an insulation displacement contact as illustrated in FIGS. 6B-6E, but constructed in accordance with an alternative embodiment.
Figure 6H:
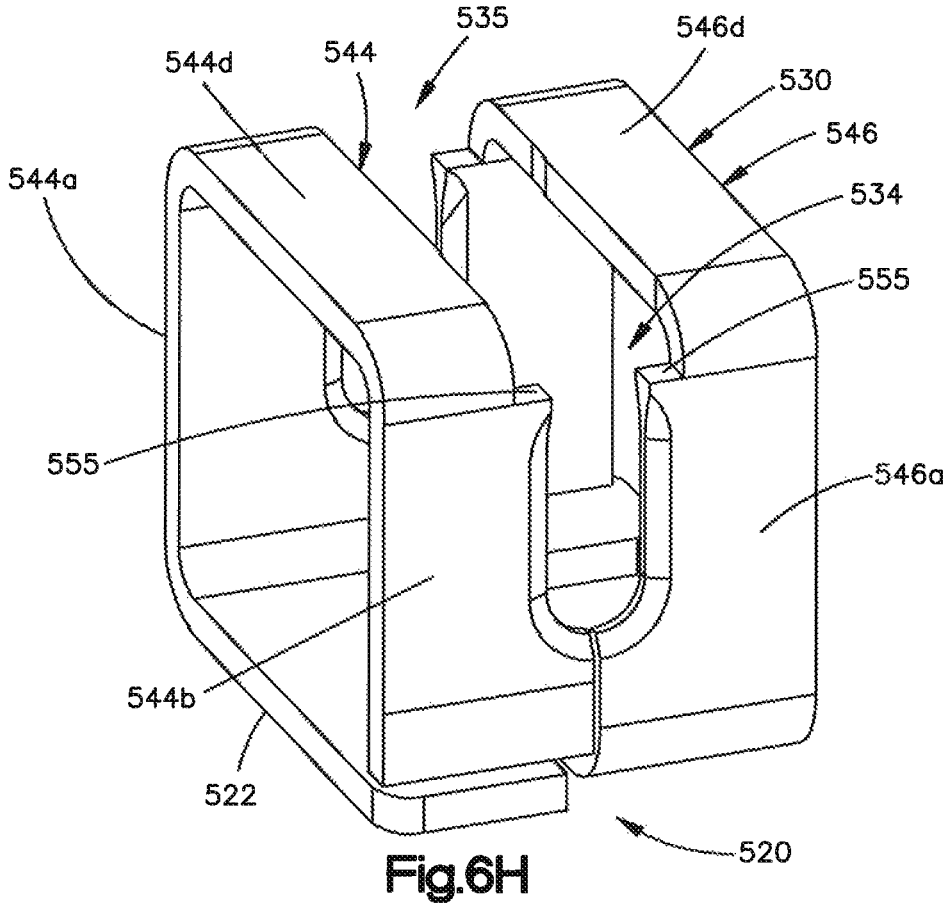
FIG. 6H is a perspective view of an insulation displacement contact as illustrated in FIG. 6G, but constructed in accordance with an alternative embodiment.
Figure 6I:
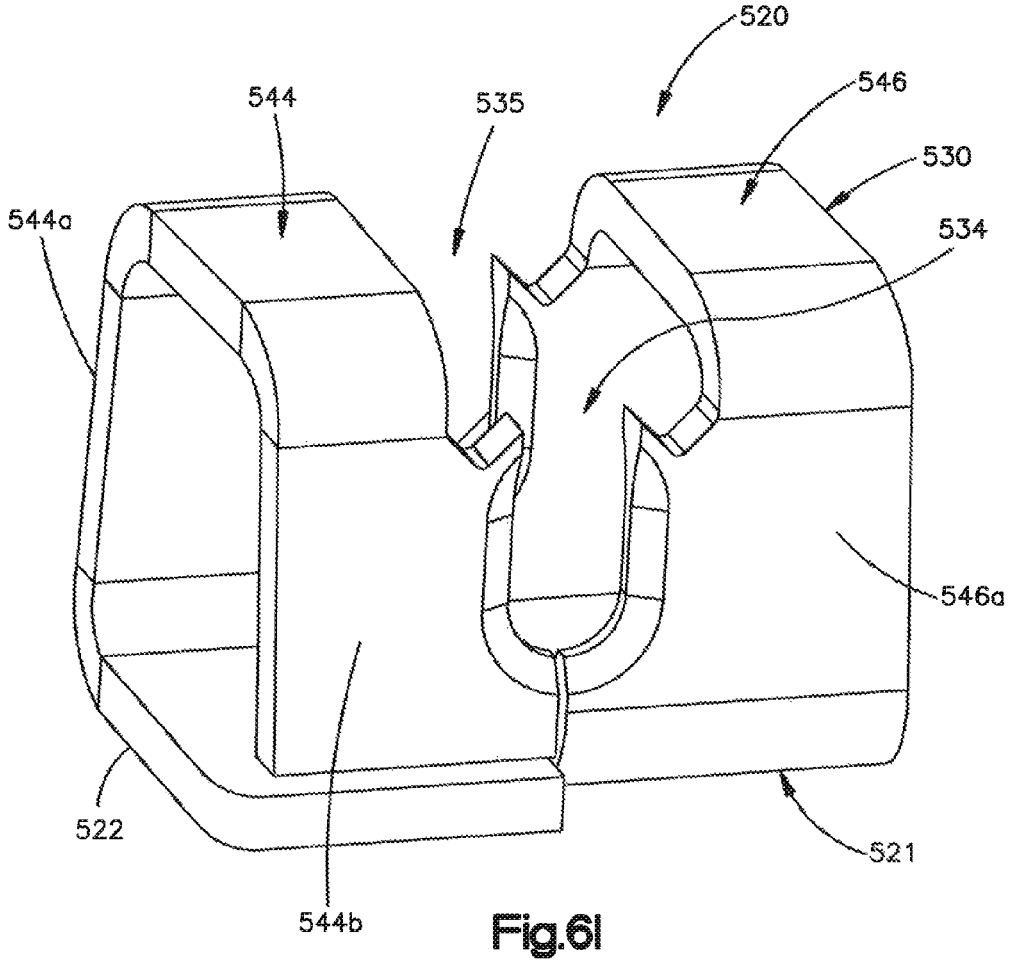
FIG. 6I is another perspective view of the insulation displacement contact as illustrated in FIG. 6G.
Figure 6J:
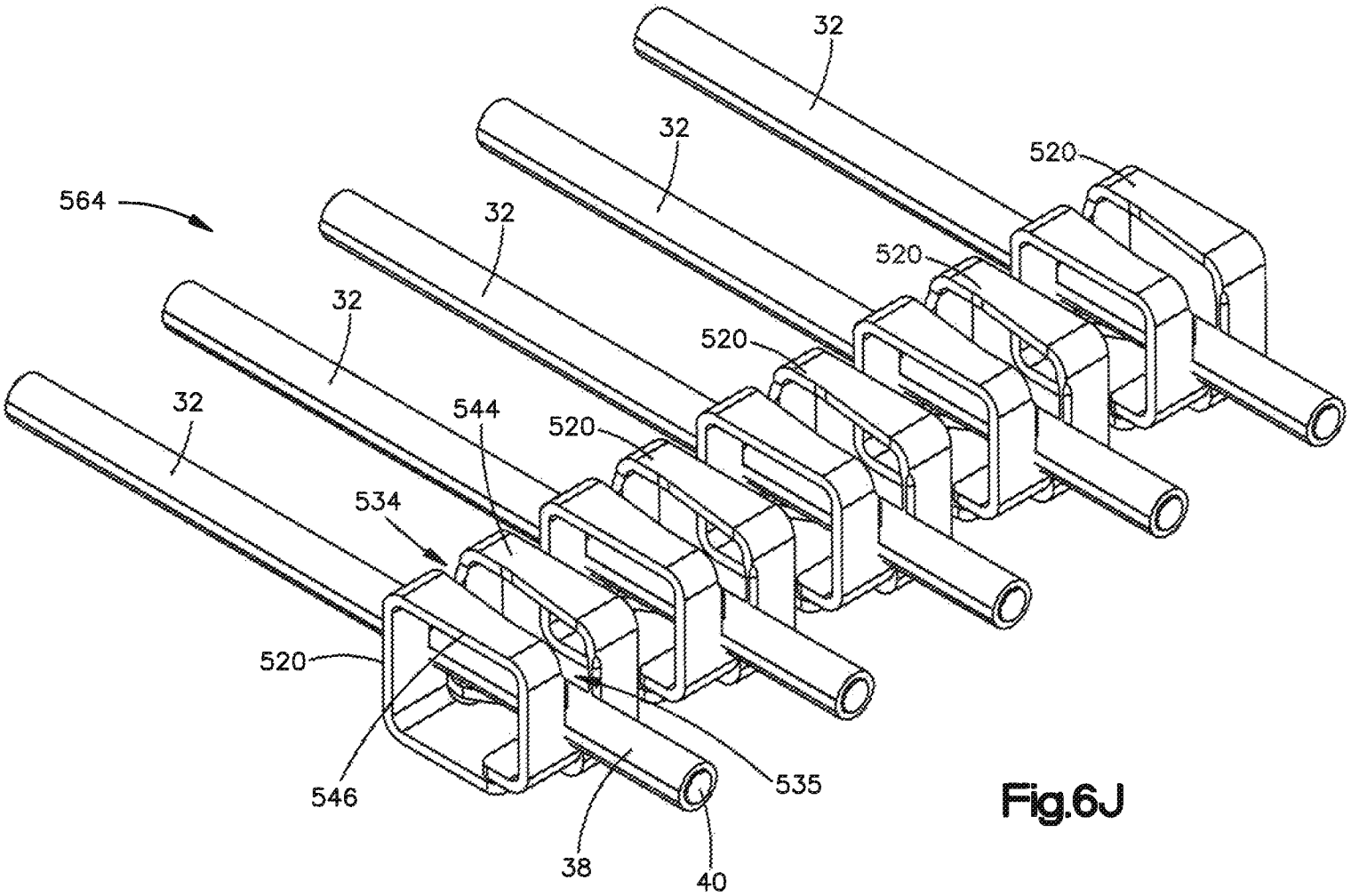
FIG. 6J is a perspective view of the insulation displacement contacts as illustrated in FIGS. 6A-I positioned as mounted onto a printed circuit board, and attached to respective electrical cables.
Figure 6K:
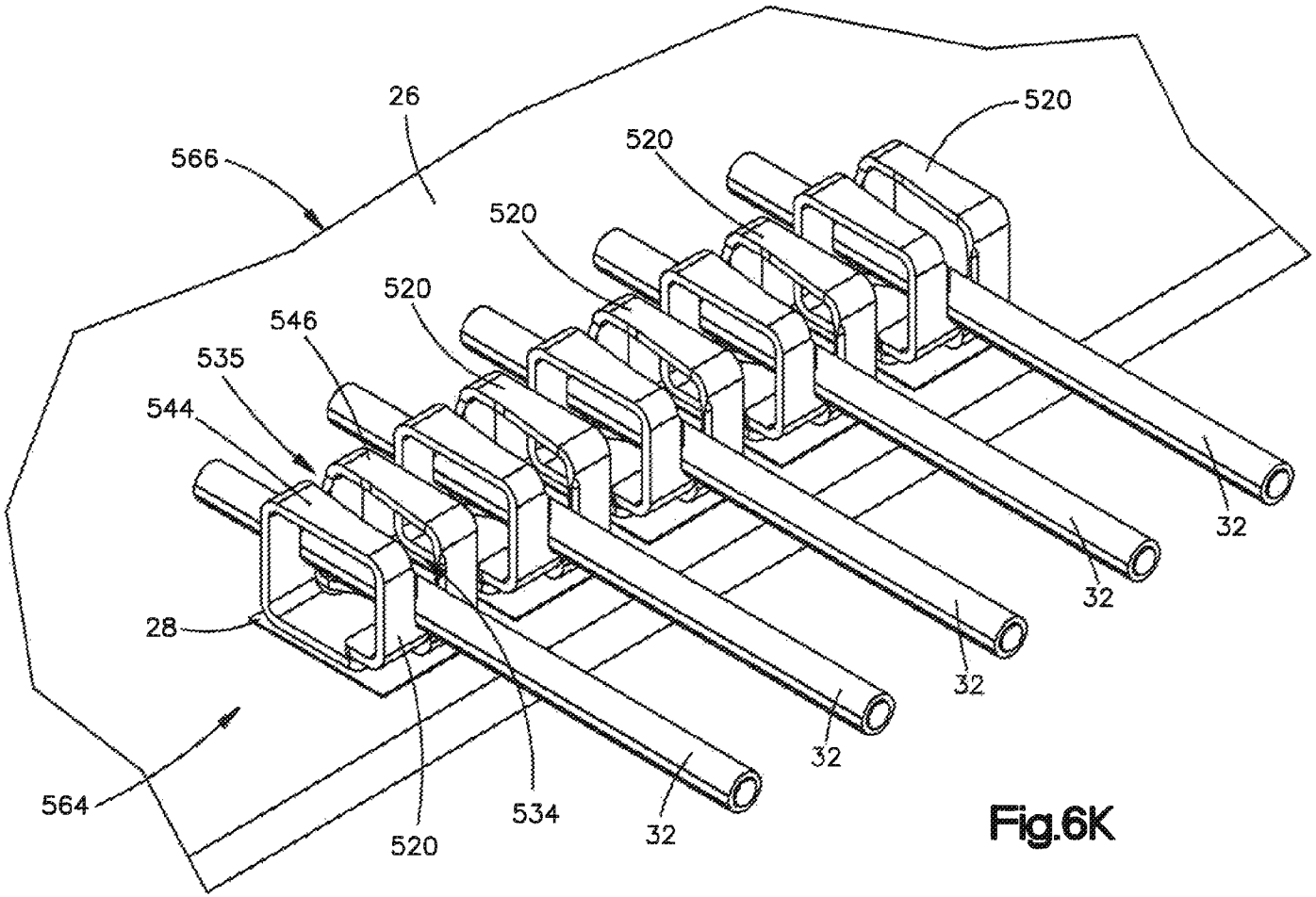
FIG. 6K is a perspective view of the insulation displacement contacts shown mounted onto a printed circuit board, and attached to respective electrical cables, as illustrated in FIG. 6J, but showing the insulation displacement contacts constructed in accordance with another alternative embodiment.
Figure 6L:
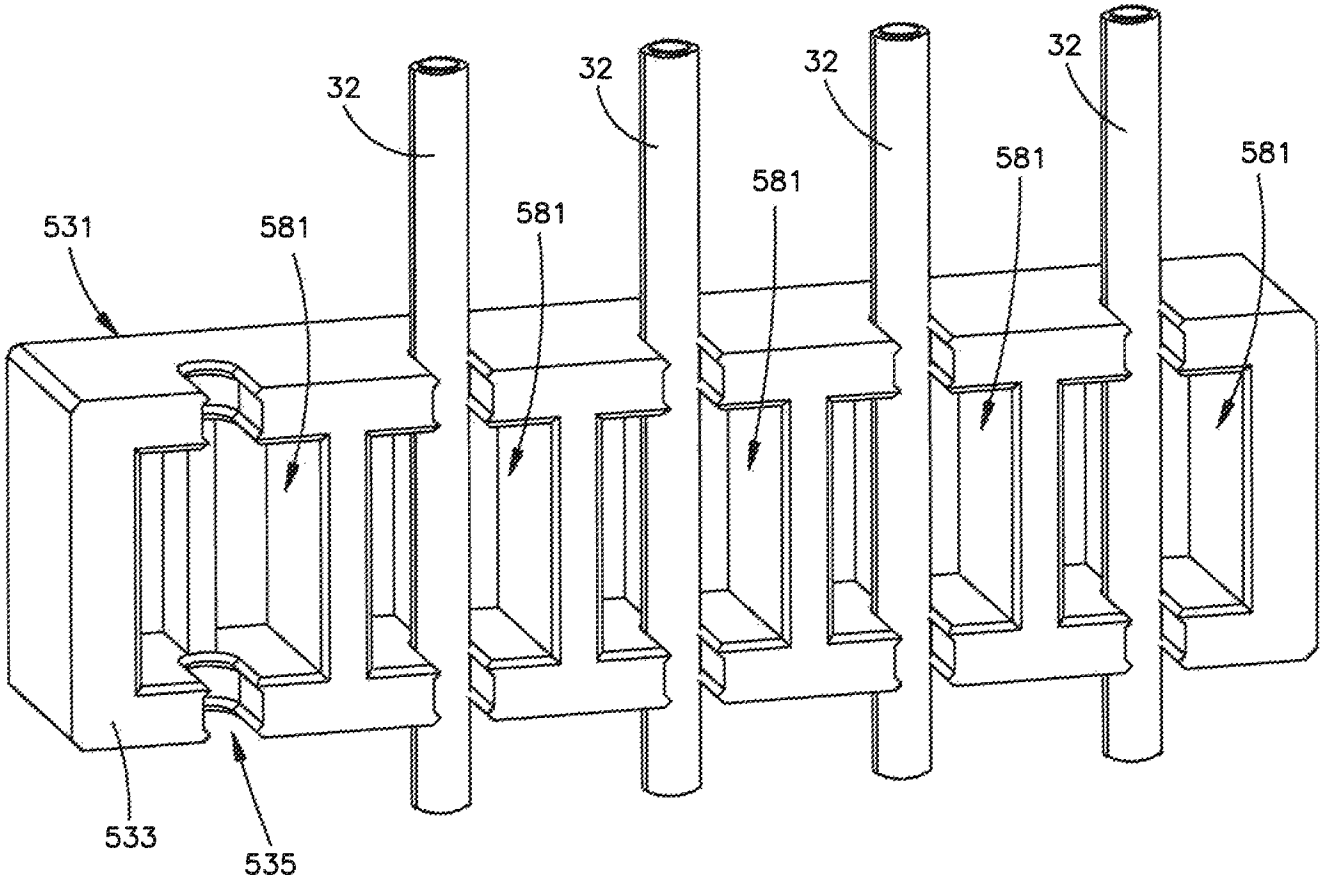
FIG. 6L is a perspective view of the electrical cables retained by the connector housing illustrated in FIG. 6A.

As illustrated in FIG. 6F, the insulation displacement contact 520 can be fabricated from a single sheet of conductive material, such as metal, that can be stamped or otherwise formed into a blank 595, which can be substantially planar or otherwise shaped as desired. The blank 595 can have a base 597 that defines the mounting portion 522, the first arm 544 that extends out from a first end of the base 597, and a second arm 564 that extends out from the second end of the base 597 that is opposite the first end of the base 597 along the longitudinal direction L. Thus, the first and second arms 544 and 546 extend out along opposite directions from the base 597. The first and second arms 544 and 546 can further be offset with respect to each other along the lateral direction A.

A method of assembling the insulation displacement contact 520 can include the step of bending the first arm 544 at a first bend location 593*a* so as to define the first proximal portion 544*a*, bending the first arm 544 at a second bend location 593*b* so as to define a first bridge 544*d*, and bending the first arm 544 at a third bend location 593*c* so as to define the first distal portion 544*b*. The method can further include the step of bending the first distal portion 544*b* at a fourth bend location 593*d* so as to define the angularly offset distal end 549*a*. The method can further include the step of bending the second arm 546 at a first bend location 599*a* so as to define the second proximal portion 544*b*, bending the second arm 546 at a second bend location 599*b* so as to define the second bridge 546*d*, and bending the second arm 546 at a third bend location 599*c* so as to define the second distal portion 546*b*. The method can further include the step of bending the second distal portion 546*b* at a fourth bend location 599*d* so as to define the angularly offset distal end 549*b*. The first, second, third, and fourth bend locations of each of the first and second arms 544 and 546 can be sequentially spaced further from the base 597 along the longitudinal direction L, and can be oriented along the lateral direction A.

A method can be provided for placing the electrical cable 32 in electrical communication with the complementary electrical component 26. The method can include the steps of placing the mounting portion 522 in electrical communication with the complementary electrical component 26, and inserting the electrical cable 32 into both of a pair of slots 534 and 535 that are defined by and between 1) the first arm 544 that extends out from the first end of the mounting portion 522 and toward the second end of the mounting portion 522, and 2) the second arm 546 that extends out from the second end of the mounting portion 522 and extends toward the first end of the mounting portion 522. The method can further include the step of piercing with the piercing member 536 the outer electrically insulative layer 38 of the electrical cable 32 and contacting the electrical conductor 40 of the electrical cable 32 that is disposed inside the electrically insulative layer 38. The piercing member 536 can be defined by at least one or both of the first and second arms 544 and 546, and can at least partially define at least one or both of the first and second slots 534 and 535. The inserting step can cause the piercing step. The placing step can be performed before or after the inserting step. The electrical cable 32 can extend at least into or through the connector housing 531, and the inserting step can further include placing the connector housing 531 adjacent the insulation displacement contact 522.

The inserting step can further include receiving the insulation displacement contact 520 in the connector housing 531. Each of the first and second arms 544 and 546 can include a piercing member 536 that at least partially defines each of the first and second slots 534 and 535, respectively, and the piercing step can further include piercing with each of the piercing members 536 the outer electrically insulative layer 38 and contacting the electrical conductor 40. Thus, the electrical conductor 40 is contacted at two locations, for instance radially opposite locations of the contact body 521 within each of the slots 534 and 535. The method can include the step of applying electrical current between the electrical cable 32 and the complementary electrical component 26. The method can include the step of applying a data signal between the electrical cable and the complementary electrical component.

A method of selling one or more up to all of the insulation displacement contact 520, the insulation displacement connector 564, and the connector assembly 566 can include the step of teaching to a third party one or more up to all of the method steps disclosed above, the insulation displacement contact 520, the insulation displacement connector 564, and the connector assembly 566. The method can further include the step of selling to the third party at least one or more up to all of the insulation displacement contact 520, the insulation displacement connector 564, and the electrical connector assembly 566.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Thus, each insulation displacement contact can include one or more up to all features, including structure and methods, alone or in combination, as the other insulation displacement contacts as described herein. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An insulation displacement contact, comprising: an electrically conductive contact body including:

a mounting portion that is configured to be mounted onto a complementary electrical component so as to contact an electrical terminal of the complementary electrical component, the mounting portion defining first and second opposed ends spaced from each other along a longitudinal direction; and a mating portion that extends out with respect to the mounting portion, the contact body including 1) an insulation displacement contact slot that extends through the mating portion in the longitudinal direction, and 2) a strain relief slot that extends through the mating portion in the longitudinal direction;

wherein the strain relief slot is aligned with the insulation displacement contact slot along the longitudinal direction so that when an electrical cable extends through the both slots along the longitudinal direction, 1) a piercing member that at least partially defines the insulation displacement contact slot pierces an outer electrically insulative layer of the electrical cable and contacts an electrical conductor of the electrical cable that is disposed inside the electrically insulative layer, and 2) opposed inner surfaces that at least partially define the strain relief slot grip the outer electrically insulative layer without extending through the outer electrically insulative layer to the electrical conductor; and wherein the mating portion defines a first pair of opposed inner surfaces that at least partially define the insulation displacement contact slot and define a first cross-sectional dimension therebetween along a lateral direction so as to present at least one piercing member that pierces an outer electrically insulative layer of the electrical cable disposed in the insulation displacement contact slot so as to extend through the electrically insulative layer and contact the electrical conductor, wherein the lateral direction is perpendicular to the longitudinal direction; and wherein the mating portion comprises an arm that extends out with respect to the mounting portion, the arm including a first portion that defines the insulation displacement contact slot, and a second portion that defines the strain relief slot, wherein the arm defines a bent region between the slots, the first portion extends outward along a direction away from the mounting and toward the bent region, and the second portion extends inward from the bent region.

2. The insulation displacement contact as recited in claim 1, wherein the arm extends out from the mounting portion, such that both the insulation displacement contact slot and the strain relief slot are disposed between the mounting portion and the bent region with respect to a transverse direction that is perpendicular to each of the longitudinal direction and the lateral direction.

3. The insulation displacement contact as recited in claim 1, wherein the mating portion is monolithic with the mounting portion.

4. An insulation displacement contact, comprising: an electrically conductive contact body including:

a mounting portion that is configured to be mounted onto a complementary electrical component so as to contact an electrical terminal of the complementary electrical component, the mounting portion defining first and second opposed ends spaced from each other along a longitudinal direction; and a mating portion that extends out with respect to the mounting portion, the contact body including 1) an insulation displacement contact slot that extends through the mating portion in the longitudinal direction, 2) a strain relief slot that extends through the mating portion in the longitudinal direction, and 3) a cutting slot that extends through the mating portion in the longitudinal direction; and wherein the strain relief slot is aligned with the insulation displacement contact slot along the longitudinal direction so that when an electrical cable extends through the both slots along the longitudinal direction, 1) a piercing member that at least partially defines the insulation displacement contact slot pierces an outer electrically insulative layer of the electrical cable and contacts an electrical conductor of the electrical cable that is disposed inside the electrically insulative layer, and 2) opposed inner surfaces that at least partially define the strain relief slot grip the outer electrically insulative layer without extending through the outer electrically insulative layer to the electrical conductor; and wherein the strain relief slot defines an open end and a closed end that is opposite the open end, and both the insulation displacement contact slot and the strain relief slot are configured to receive the cable along an insertion direction that is defined from the open end toward the closed end; and wherein the cutting slot defines a cutting surface that is aligned with both the insulation displacement contact slot and the strain relief slot along the longitudinal direction and is configured to sever a portion of the cable that extends through the strain relief slot and the insulation displacement contact slot; and wherein the insulation displacement contact slot is a first insulation displacement contact slot, and the mating portion further defines a second insulation displacement contact slot at least partially defined by a piercing member that is configured to pierce the outer electrically insulative layer and contact the electrical conductor when the electrical cable is disposed in the second insulation displacement contact slot.

5. The insulation displacement contact as recited in claim 4, wherein the second insulation displacement contact slot is aligned with the first insulation displacement contact slot along the longitudinal direction.

6. The insulation displacement contact as recited in claim 5, wherein the first insulation displacement contact slot is disposed between the second insulation displacement contact slot and the strain relief slot along the longitudinal direction.

7. The insulation displacement contact as recited in claim 6, wherein the mating portion comprises a first arm that extends out with respect to a first end of the mounting portion, the arm including a first portion that defines the insulation displacement contact slot, and a second portion that defines the strain relief slot, and a second arm that extends out with respect to a second end of the mounting portion, the second arm defining the second insulation displacement contact slot.

8. An insulation displacement connector, comprising the insulation displacement contact as recited in claim 4, and a connector housing that includes a housing body and a cable retention channel that extends through the housing body, wherein the cable retention channel is configured to receive the electrical cable, and is further configured to be moved with respect to the insulation displacement contact along the insertion direction, so as to insert the electrical cable into the first and second insulation displacement contact slots and the strain relief slot.

9. The insulation displacement connector as recited in claim 8, wherein the cable retention channel is substantially closed about its perimeter.

10. The insulation displacement connector as recited in claim 9, wherein at least a portion of the cable retention channel is open at one end, and the one end is a lower end that faces the mounting portion when the retained cable is inserted into the slots of the mating portion.

11. The insulation displacement connector as recited in claim 8, wherein the connector housing is configured to rest against the complementary electrical component when the retained cable is fully seated in the slots of the mating portion.

12. The insulation displacement connector as recited in claim 8, wherein the connector housing defines a plurality of cable retention channels each configured to receive an electrical cable that is inserted in the slots of the mating portions of respective ones of a plurality of insulation displacement contacts.

13. The insulation displacement connector as recited in claim 8, further comprising a plurality of insulation displacement contacts as recited in claim 1, each of the plurality of insulation displacement contacts supported by the connector housing.

* * * * *